US006829867B2

(12) United States Patent
Gresser et al.

(10) Patent No.: US 6,829,867 B2
(45) Date of Patent: Dec. 14, 2004

(54) BLOCKS AND BLOCK FORMING APPARATUS AND METHOD

(75) Inventors: Michael J. Gresser, Prior Lake, MN (US); Stanley W. Hamilton, Plymouth, MN (US); Charles E. Carter, Inver Grove Heights, MN (US); Anders M. Ruikka, Zimmerman, MN (US); Thomas J. Brion, Monticello, MN (US); Lawrence J. Ebert, Zimmerman, MN (US); James M. Barthel, Coon Rapids, MN (US); Mathew A. Barron, Eagan, MN (US)

(73) Assignee: ReCon Wall Systems, Inc., Eagan, MN (US)

( * ) Notice: Subject to any disclaimer, the term of this patent is extended or adjusted under 35 U.S.C. 154(b) by 0 days.

(21) Appl. No.: 10/645,964

(22) Filed: Aug. 22, 2003

(65) Prior Publication Data

US 2004/0065042 A1 Apr. 8, 2004

Related U.S. Application Data

(62) Division of application No. 09/788,836, filed on Feb. 20, 2001, now Pat. No. 6,620,364.

(51) Int. Cl.[7] ..... E04B 5/04

(52) U.S. Cl. ..... 52/603; 52/596; 52/604; 52/605; 52/608; 405/284; 405/286; 405/287; 405/262

(58) Field of Search ..... 52/596, 603, 604, 52/605, 608; 405/284, 286, 287, 262

(56) References Cited

U.S. PATENT DOCUMENTS 770,677 A 9/1904 Cuatt 776,137 A 11/1904 Jackson (List continued on next page.)

FOREIGN PATENT DOCUMENTS

| | | |
|---|---|---|
| CA | 1210249 | 8/1986 |
| FR | 2220990 A | 11/1974 |

OTHER PUBLICATIONS

National Concrete Masonry Assn., "Segmental Retaining Walls", Herndon, VA, 2nd Edition (date unknown).

Cleco Mfg. brochure, Wallingford, CT, 2 pages (date unknown).

International Pipe Machinery Corp. brochure, Quinn Wet Cast Septic Tank Form, 1 page (date unknown).

Spillman; Columbus, Ohio, brochure, 2 pages (date unknown).

(List continued on next page.)

*Primary Examiner*—Carl D. Friedman
*Assistant Examiner*—Steve Varner
(74) *Attorney, Agent, or Firm*—Merchant & Gould P.C.

(57) ABSTRACT

A retaining wall block is provided. The retaining wall block includes top, bottom, front, back, first side and second side surfaces. A tongue set is provided on the top surface of the block and a groove in the bottom surface of the block. The tongue set includes a rear-facing surface set that includes first and second curved sections. A block form for forming retaining wall blocks is also provided. A face form for placement on the bottom surface of a block form is also provided. A method of molding retaining wall blocks with a form having hinged doors is also provided. A method of using a face form for forming two blocks of reversed front surface ornamentation is also provided.

6 Claims, 16 Drawing Sheets

U.S. PATENT DOCUMENTS

| | | | | | |
|---|---|---|---|---|---|
| 788,955 | A | | 5/1905 | Shone | |
| 795,900 | A | | 8/1905 | Doughty | |
| 1,332,246 | A | | 3/1920 | Coates | |
| 1,581,797 | A | | 4/1926 | Fey | |
| 1,584,920 | A | | 5/1926 | Flint et al. | |
| 2,121,450 | A | | 9/1938 | Sentrop | |
| 2,953,469 | A | | 9/1960 | Fox | |
| 3,058,164 | A | | 10/1962 | Rowe | |
| 3,546,052 | A | | 12/1970 | McNamara | |
| 3,966,166 | A | | 6/1976 | Elliott | |
| 4,043,826 | A | | 8/1977 | Hum | |
| 4,070,849 | A | | 1/1978 | DiGiacomo | |
| 4,197,684 | A | | 4/1980 | Johnson | |
| 4,331,734 | A | | 5/1982 | Stegmeier | |
| 4,490,075 | A | | 12/1984 | Risi et al. | |
| 4,500,275 | A | | 2/1985 | Ruhl | |
| D280,024 | S | | 8/1985 | Risi et al. | |
| 4,815,897 | A | | 3/1989 | Risi et al. | |
| 4,819,874 | A | | 4/1989 | Geiger | |
| 4,847,026 | A | | 7/1989 | Jarboe et al. | |
| 4,909,010 | A | | 3/1990 | Gravier | |
| 4,960,622 | A | | 10/1990 | Jarboe et al. | |
| 5,273,251 | A | | 12/1993 | Badstieber | |
| 5,406,054 | A | | 4/1995 | Chirdon | |
| 5,435,949 | A | | 7/1995 | Hwang | |
| 5,484,236 | A | | 1/1996 | Gravier | |
| 5,487,526 | A | | 1/1996 | Hupp | |
| D370,272 | S | | 5/1996 | Risi et al. | |
| 5,622,456 | A | | 4/1997 | Risi et al. | |
| 5,623,797 | A | | 4/1997 | Gravier et al. | |
| 5,637,236 | A | | 6/1997 | Lowe | |
| 5,667,200 | A | | 9/1997 | Kelley, Jr. | |
| 5,817,248 | A | | 10/1998 | Forlini | |
| D411,315 | S | | 6/1999 | Bott | |
| 5,935,317 | A | | 8/1999 | Soroushian et al. | |
| 5,937,601 | A | | 8/1999 | McDonald | |
| 5,943,234 | A | | 8/1999 | Martinez et al. | |
| 6,000,183 | A | | 12/1999 | Newman | |
| 6,032,488 | A | | 3/2000 | Deruyter et al. | |
| 6,035,583 | A | | 3/2000 | Papke | |
| 6,053,661 | A | * | 4/2000 | Lewis | 405/36 |
| 6,082,067 | A | | 7/2000 | Bott | |
| 6,250,850 | B1 | * | 6/2001 | Price et al. | 405/284 |
| 6,416,257 | B1 | * | 7/2002 | Rainey | 405/262 |
| 6,557,818 | B2 | | 5/2003 | Manthci | |
| 6,592,301 | B2 | * | 7/2003 | Price et al. | 405/284 |
| 6,620,364 | B2 | | 9/2003 | Gresser et al. | |
| 6,679,656 | B1 | * | 1/2004 | Manthei | 405/284 |
| 6,682,269 | B2 | * | 1/2004 | Price et al. | 405/284 |
| 2001/0019684 | A1 | | 9/2001 | Manthei et al. | |

OTHER PUBLICATIONS

Elk River Machine Co., Photographs of Retaining Walls, entitled "Retaining Wall Form", 4 pages (date unknown).

Rempel Bros. of Canada brochure, 1 page (1999).

Rempel Bros. Concrete Ltd., http://www.rempelbros.com/what's_new/content/mainb.htm, 1 page (2000).

Armcon Ltd. brochure, LocBloc™ Retaining Wall Block, http://www.armcon.com/frames.html, 1 page, (2001).

Allan Block brochure, 1 page, and photos, (1994).

Concrete Gabions brochure, 2 pages (date unknown).

Lok Blok Retaining Systems, http://www.lokblok.co.za/, 1 page (2001).

Loffelstein® brochure, 2 pages (1989).

American Redi–Bloc™ brochure, 2 pages (2000).

Risi Stone Systems brochure, 2 pages (1994).

Unilock brochure, http://www.unilock.com/walls/index.html, 2 pages (2001).

PISA II Retaining Wall System, http://www.risistone.com/systems/p2/frames/p2ctxt.htm, 5 pages (2001).

United Lock–Block™ Ltd., http://www.unitedlockblock.com/products.htm, 2 pages (2000).

Octa Bloc™ Precast Block Systems & Materials, http://www.rempelbros.com/products&services/content/precast.htm, 2 pages (2000).

Cleco Mfg., Inc. MCX 2000 Showguide, 2 pages (2000).

Del Zotto Products, Incorporated advertisement, *The Concrete Producer*, p. 63 (2000).

OCTA BLOC™ Presentation to Cemstone by Rempel Bros. Concrete Ltd., Orlando FL, 39 pgs (2000).

Anchor Wall Systems brochure, 2 pages, (1993).

Rinforced Earth® brochure, 4 pages (1995).

Interlock Concrete Products Inc. brochure, 3 pages (1994).

American Redi–Bloc Mfg.; http://www.americanredibloc.com/Manufacturing/Manufacturing.htm, 1 page (2000).

American Redi–Bloc Specifications, http://www.americanredibloc.com/Specifications/Specifications.htm, 1 page (2000).

American Redi–Bloc Block Styles, http://www.americanredibloc.com/BlocStyles/Bloc_Styles.htm, 2 pages (2000).

American Redi–Bloc Wall Pictures, http://www.americanredibloc.com/WallPictures/Wall_Pictures.htm, 2 pages (2000).

American Redi–Bloc Installation, http://www.americanredibloc.com/Installation/Installation.htm, 1 page (2000).

American Redi–Bloc Engineering, http://www.americanredibloc.com/Engineering/Engineering.htm, 3 pages (2000).

American Redi–Bloc Uses, http://www.americanredibloc.com/Uses/Uses.htm, 2 pages (2000).

Design Pro "TerraCrete™" Landscape Block Form System brochure, 1 page (date unknown).

Actual Drawing, The Neel Company, "T–Wall Form Liner Adapter" (1996).

Actual Drawing, Spillman Company, "Beam Forms", (1986).

Video Tape "Transform Concrete Into A New Profit Center", (copyright 2000).

Avon Manufacturing Company, Inc., "Speed–Strip Septic Tank Molds", sales brochure, dated Feb. 19, 1964.

Exhibit A, Disclosure of "Reduced Weight Slip Cast Concrete Retaining Wall Block" provided to applicant by Redi–Rock International; 9 pages; (known to Applicant as of Oct. 15, 2001).

Exhibit B, Roll–Away Form brochure, Redi–Rock International; and Rollaway Purchase Agreement, Redi–Rock International; 2 pages; (Purchase Agreement dated Feb. 6, 2001).

* cited by examiner

BLOCKS AND BLOCK FORMING APPARATUS AND METHOD

This Application is a divisonal of Ser. No. 09/788,836 Feb. 20, 2001 U.S. Pat. No. 6,620,364

FIELD OF THE INVENTION

The invention is related to retaining wall blocks and a block forming apparatus and method.

BACKGROUND OF THE INVENTION

Blocks, such as retaining wall blocks, are frequently used in landscaping. The blocks are stacked on top of each other to form the retaining wall.

A retaining wall block may include a tongue and groove on the top and bottom surfaces of the block respectively. In this way, shear forces provided by the earth behind the retaining wall do not result in slippage between overlying blocks. Typically, a block is placed on top of two underlying blocks in an overlapping fashion so that approximately half of the upper block lies over half of the first lower block and the other half of the upper block lies over half of a second lower block adjacent to the first lower block. By such an overlapping system, the strength of the wall is increased. However, it is desired to create such an overlapping system of blocks and yet have a retaining wall that curves. Use of tongue and groove blocks has made it difficult to effectively provide a curved retaining wall and still maintain sufficient resistance against the shear forces acting on the wall.

For example, use of a tongue that is narrower than the width of the groove allows some curvature in a retaining wall. However, such a retaining wall results in small points of contact between the tongue and groove. Shear forces acting on these points of contact are likely to cause shifting of the blocks as well as breakage or other failure at the small point of contact between the tongue and groove.

It is also desired to provide an apparatus and method for forming blocks in an efficient manner.

SUMMARY OF THE INVENTION

A retaining wall block is provided according to the invention. The retaining wall block includes top, bottom, front, back, first side and second side surfaces. A tongue set is provided on the top surface of the block and a groove in the bottom surface of the block. The tongue set includes a rear-facing surface set that includes first and second curved sections.

A face form is provided according to the invention. The face form includes a bottom surface textured to the desired shape and a wall. The wall includes first and second side walls and first and second end walls. The face form also includes a first anchor rail projecting from the first side wall and a second anchor rail projecting from the second side wall.

A block form is provided according to the invention. The block form includes a bottom surface configured for slidably receiving a face form. The bottom surface includes a first edge and a second edge. The block form also includes a first anchor rail clamp coupled to the first edge of the bottom surface and a second anchor rail clamp coupled to the second edge of the bottom surface.

A block form is provided according to the invention. The block form includes a supporting structure, four safety stops attached to the supporting structure and a bottom surface coupled to the supporting structure. The block form also includes four hinged doors having a molding position and an open position. The hinged doors each have two hinge arms hingedly connected to the supporting structure. Each hinge arm includes a lower edge that faces the supporting structure. The lower edge of at least one hinge arm from each door has a stop engaging surface substantially aligned with one of the at least four safety stops such that rotation of each of the hinged doors is stopped at the open position by the engagement of the respective stop engaging surface with the respective safety stop.

A block form is provided according to the invention. The block form includes a supporting structure and a substantially horizontal bottom surface coupled to the supporting structure. The block form also includes four hinged doors having a molding position and an open position. The block form includes a first member defining a first hole coupled to the top of the first hinged door and a second member defining a second hole coupled to the top of the second hinged door. The block form furthermore includes a safety latch having a first and second substantially parallel rods connected by a connecting section. The first and second rods are configured to fit within the first and second holes wherein the first hinged door and second hinged door can be held substantially in their molding positions by placing the first rod into the first hole and the second rod in the second hole.

A method of molding retaining wall blocks is provided according to the invention. The method includes the steps of providing a block form, rotating the first hinged door and second hinged door into substantially their molding positions, removably securing the first hinged door to the second hinged door so as to maintain the first and second hinged doors in the molding position, rotating the third and fourth hinged doors into substantially the molding positions, moving a locking mechanism into its locked position, and pouring moldable concrete into the molding cavity.

A block form is provided according to the invention. The block form includes a supporting structure and a substantially horizontal bottom surface coupled to the supporting structure. The block form also includes four hinged doors having a molding position and an open position. The block form also includes a first protrusion coupled to the first hinged door and a second protrusion coupled to the second hinged door. The first protrusion includes a substantially planar first prying surface and the second protrusion includes a substantially planar second prying surface. The gap between the first and second prying surfaces is between 0.1 inches and 2.0 inches.

A method of using a face form for forming two blocks of reversed front surface ornamentation is provided according to the invention. The method includes the steps of providing a block form, providing a face form in a first orientation on the bottom surface of the block form, pouring moldable concrete into the block form to form a first block, removing the first formed block from the block form, removing the face form from the block form, providing the face form in a second orientation on the bottom surface of the block form, and pouring moldable concrete into the block form to form a second block.

DETAILED DESCRIPTION OF THE PREFERRED EMBODIMENT

Figure 1:
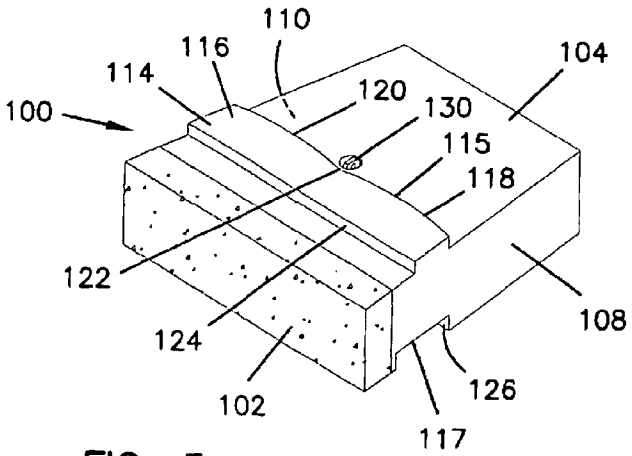
FIG. 1 is an upper perspective view of a full block according to the principles of the invention.
Figure 2:
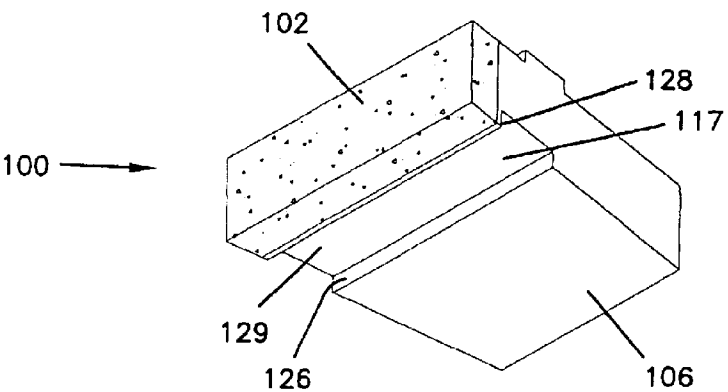
FIG. 2 is a lower perspective view of a full block according to the principles of the invention.
Figure 6:
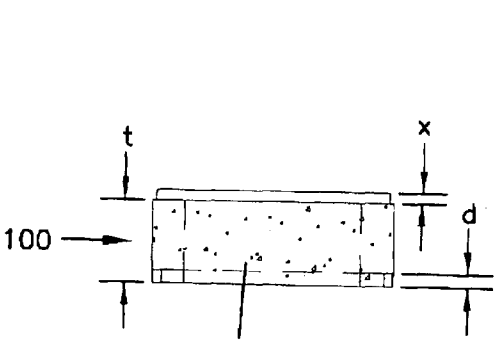
FIG. 6 is a front view of a full block according to the principles of the invention.

With reference now to the various figures in which identical elements are identically numbered throughout, a description of the preferred embodiment of the present invention will now be provided. First, the retaining wall blocks will be described. Second, the block forms for efficiently molding the blocks will be described.

Blocks

Retaining wall blocks are typically stacked in layers one on top of the other to form a retaining wall. Many different types of landscaping and engineering applications and locations require different size and shape retaining walls. It is typically desired to stack the blocks in such a way that an overlying block is centered over the junction between two underlying blocks. This "staggered" stacking of retaining wall blocks strengthens the retaining wall.

It is also typically desired to stack the retaining wall blocks with a setback. That is, each ascending layer of blocks is setback slightly from the underlying layer of blocks. What is meant by the term setback is that the front surface of an upper block is set into the wall further than the front surface of a lower block.

A retaining wall may include one or more different types of retaining wall blocks. There is the standard or full block, a half block, a corner block and a top block. The full block is the block that is typically used to form the majority of the wall. Because of the staggered layering of the blocks, it is sometimes necessary to utilize a half block to fill in a space in the wall that is only half the width of a full block. Therefore, half blocks are typically half the width of a full block. If a retaining wall requires a corner, a corner block is used at the juncture between the two generally perpendicular wall surfaces. Lastly, the top block is utilized in the very top layer of blocks in the retaining wall. Each of these various types of blocks will be described further below.

A retaining wall full block includes a front surface, which is the surface that is viewed when the block is placed in a retaining wall. The front surface is designed to be aesthetically pleasing. The front surface may include indentations and protrusions and other design markings. The front surface may also be colored as desired, for example with paint or stain. Front surface of a full block may be planar in shape or it may be made up of multiple planes. Alternatively, the front surface of a full block may be curved or even a combination of a curve and one or more planar surfaces. The goal for the front surface is to provide an aesthetically pleasing appearance.

A retaining wall full block also includes a top surface and a bottom surface. The top surface is the surface facing up when the retaining wall block is positioned in a retaining wall. The bottom surface is the surface facing down. The top surface must be configured to accept the bottom surface of an overlying block. One way to ensure that a first full block will properly sit on a second full block is to make the top surface and the bottom surfaces planar and horizontal. However, any design of the top and bottom surfaces that allows a first full block to remain in a stable position on one or more underlying blocks is acceptable.

A retaining wall block also includes a first side surface and a second side surface. The first and second side surfaces can be any shape and design that allows adjacent retaining wall blocks to be positioned next to each other without significant gaps between adjacent front surfaces.

A retaining wall block also includes a back surface opposite the front surface. The back surface faces the earth or other fill material that is behind the retaining wall. All different shapes and designs of the back surface may be used in accordance with this invention.

A retaining wall full block, according to the principles of this invention, also includes a tongue set protruding from the top surface of the block. A full block also includes a groove in the bottom surface of the block.

A tongue set is one or more protrusions or tongues from the top surface of the block. The tongue set must fit within a groove of an overlying block wherein such overlying block might be a full block, half block, top block or corner block. The highest protrusion of a tongue set must be no higher than the depth of a groove in an overlying block. In this way, an overlying block may be placed onto a lower block with the tongue set of the lower block positioned within the groove of the upper block.

FIG. 1 shows a preferred embodiment of a retaining wall block pursuant to the principles of this invention. Retaining wall full block 100 includes front surface 102 that is generally planar but that also includes indentations, bumps and texture for providing ornamentation. It may be desired, for example, to simulate the appearance of limestone or other natural rocks to present an aesthetically pleasing appearance on the front surface. Retaining wall block 100 includes top surface 104 and bottom surface 106. In this preferred embodiment, top surface 104 and bottom surface 106 are generally planar with the exceptions of the tongue and groove and lifting mechanism as will be described below. Retaining wall block 100 includes first and second side surfaces 108 and 110. First and second side surfaces 108 and 110 are planar. Block 100 also includes back surface 105 that is a planar surface opposite from front surface 102.

Retaining wall block 100 includes tongue set 114 on its top surface 104. Tongue set 114 is made up of tongue 116. Tongue 116 is a single protrusion raised above the planar top surface 104. Retaining wall block 100 also includes groove 117 extending from first side surface 108 to second side surface 110 in bottom surface 106.

A tongue set includes a front-facing surface set and a rear-facing surface set. A front-facing surface set is the surface of the tongue set nearest to the front surface of the block. A front-facing surface set is one or more front-facing surfaces. A front-facing surface is a surface of a tongue that faces the front surface of the block. That is, any point on a surface of the tongue belongs to the front-facing surface of that tongue when a line normal to the surface at that point would cross the front surface of the block. A front-facing surface set can be any shape, including but not limited to a planar surface and a curved surface or a set of planar and/or curved surfaces.

A rear-facing surface set is one or more rear-facing surfaces. A rear-facing surface is the surface on a tongue that faces the back surface or the first or second side surfaces of the full block. That is, any point on a surface of the tongue belongs to the rear-facing surface when a line normal to the surface at that point would cross the rear surface or the first or second side surfaces of the full block.

A rear-facing surface of a full block pursuant to the present invention may include a curved section. A curved section is a nonlinear section. A curved section will typically be a portion of a circle having a radius. However, a curved section does not have to be a perfect circle and could be, for example, a portion of an oval or other noncircular curve. The apex of a curved section is the point on the curved section that is furthest from the front face of the block.

A rear-facing surface set may include more than one curved section. The junction between two curved sections is defined as a relative or local minimum (as defined in calculus) along the function defined by the curve of the rear-facing surface set (extending such rear-facing surface set for purposes of this function to make it continuous). The relative or local minimum analysis is performed with the x-axis long the front surface of the block and the y-axis extending positively toward the back surface of the block.

The radius of a curved section that is non-circular is defined as the effective radius, which is defined as the radius of a circle whose second derivative (calculus) is the same as the second derivative of the curved section taken at the apex of the curved section.

In a preferred embodiment, tongue 116 includes a rear-facing surface 115 that includes a first curved section 118 and second curved section 120 with a local or relative minimum 122 defining the junction between the first and second curved sections 118 and 120. The tongue 116 also includes front-facing surface 124 that is planar.

Groove 117 is defined by front-facing surface 126, rear-facing surface 128, and groove surface 129.

It is often desired to build a retaining wall that contains a gradual curve as opposed to a ninety-degree corner. Such a gradual curve may be convex or it may be concave in shape. Placing adjacent blocks such that the front faces of the adjacent blocks are not coplanar forms a gradually curved wall. If a tongue is designed to fit snugly within the groove of an overlying block, such non-coplanar positioning of adjacent blocks will result in an inability to fit the adjacent tongue sets into the groove of the overlying block. It is noted that concave or convex walls may be created by utilizing blocks in which the rectangular shaped tongue is narrower than the groove of the overlying block. However, such a tongue and groove system results in very small points of contact between the rear-facing surface of the tongue and the overlying groove when used to form a curved retaining wall. Shear forces from the earth pushing on the back surface of on upper block can result in shifting and possibly breaking of blocks due to the small point of contact between tongue and groove of overlying blocks.

Figure 3:
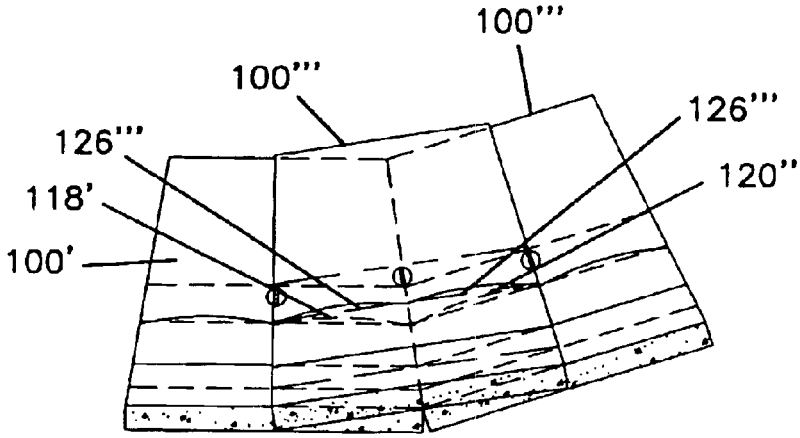
FIG. 3 is a top view of a full block on top of two underlying full blocks to form a portion of a convex retaining wall according to the principles of the invention.
Figure 4:
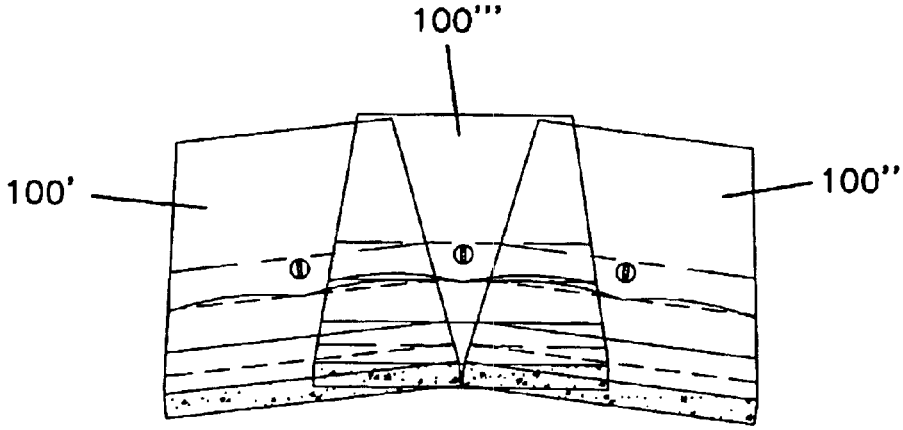
FIG. 4 is a top view of a full block on top of two underlying full blocks to form a portion of a concave retaining wall according to the principles of the invention.

FIGS. 3 and 4 show a block 100''' positioned on top of two underlying blocks 100' and 100'' as would be done in a preferred retaining wall. FIG. 3 illustrates the three blocks, as they would be positioned to form a convex wall. FIG. 4 is a portion of a concave wall.

As shown in FIGS. 3 and 4, the present invention provides a tongue set having a rear-facing surface set having a first and second curved sections such that the surface area of contact between the front-facing surface of the groove and the rear-facing surface set of the tongue set is increased to better handle the shear forces exerted on the blocks. For example, front-facing surface 126''' of the groove of the upper block 100''' is pushed up against the rear-facing surface 120'' of the tongue of the underlying block 100''. This increase in surface area contact between the front-facing surface of the groove and the rear-facing surface set of the tongue can be accomplished while at the same time providing curved walls of either the convex type, as shown in FIG. 3, or the concave type, as shown in FIG. 4.

Figure 7:
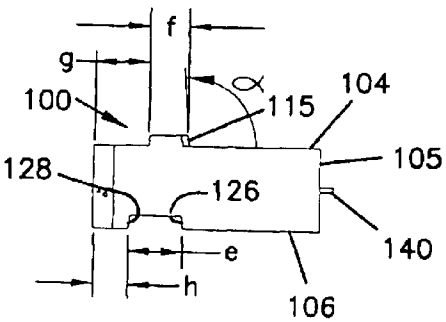
FIG. 7 is a side view of a full block according to the principles of the invention.

Turning now to FIG. 7, the angle $_\alpha$ is the angle between the rear-facing surface set of the tongue set and the top surface of the block. The angle $_\alpha$ may be any angle for which the interaction of the tongue set with the groove can withstand typical shear forces that are experienced in a retaining wall without damage or breakage between upper and lower blocks. An angle $_\alpha$ less than ninety degrees makes it difficult to manufacture the block because it is difficult to remove the block from the mold or the mold from the block as will be appreciated later below in the discussion of the machine for molding the blocks. Therefore, in a preferred embodiment angle $_\alpha$ is greater than or equal to ninety degrees. An angle $_\alpha$ greater than ninety degrees has been found to assist in opening the doors of the molding machine for forming the blocks as is discussed below. On the other hand, the closer the angle $_\alpha$ is to ninety degrees, the less likely the front-facing surface of a groove in an upper block is to ride up on the rear-facing surface of the tongue of the block below under the shear forces retaining walls typically experience.

In a preferred embodiment, the angle $_\alpha$ is between ninety degrees and one hundred degrees. More preferably, the angle $_\alpha$ is between ninety-two degrees and ninety-six degrees. More preferably still, the angle $_\alpha$ is ninety-four degrees.

Preferably the slope of the rear-facing surface set relative to the top surface is constant. That is, the angle $_\alpha$ should not increase as you move up the rear-facing surface set toward the top of the tongue. A changing slope would increase the likelihood of the upper block sliding up on the lower block.

The front-facing surface of the groove is preferably a surface that matches the angular orientation of the angle $_\alpha$ of the rear-facing surface of the tongue. In such a preferred embodiment, the matching angles on the front-facing surface of the groove and the rear-facing surface of the tongue result in maximizing the area of surface contact between those two surfaces. In a preferred embodiment, the front-facing surface 126 of the groove is planar and preferably at a 94 degree angle to the bottom surface 106 to match the preferred 94 degree angle of the rear-facing surface 115 of the tongue 116 relative to the top 104.

It is noted that in order to build a curved wall that is convex in its curvature, the first and second side surfaces of the block must be at an angle relative to the front of the retaining wall of less than ninety degrees. Without considering limitations due to the specific tongue-in-groove design, the smaller the angle between the first and second side surfaces and the front of the retaining wall, the greater curvature that can be obtained in a convex wall.

Figure 5:
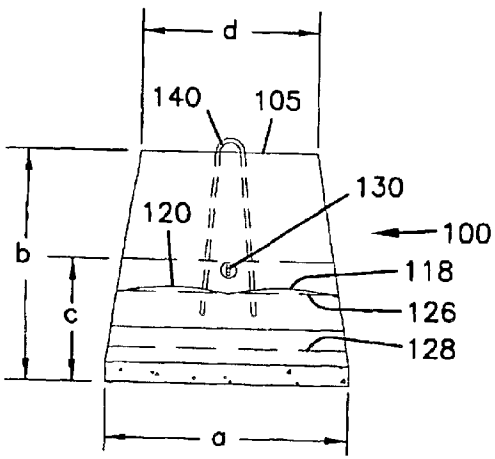
FIG. 5 is a top view of a full block according to the principles of the invention.

In a preferred embodiment shown in FIG. 5, the angle between the planar front surface 102 of the block 100 and the first side surface 108 is 81 degrees. Likewise the angle between the front surface 102 and the second side surface 110 is 81 degrees.

In order to move and maneuver the retaining wall blocks, it is desired to incorporate into the block a mechanism that can be latched onto for lifting the block. Many different types of lifting mechanisms can be embedded in the block for this purpose. The location of the embedded lifting mechanism should be substantially at the center of gravity of the block.

Figure 8:
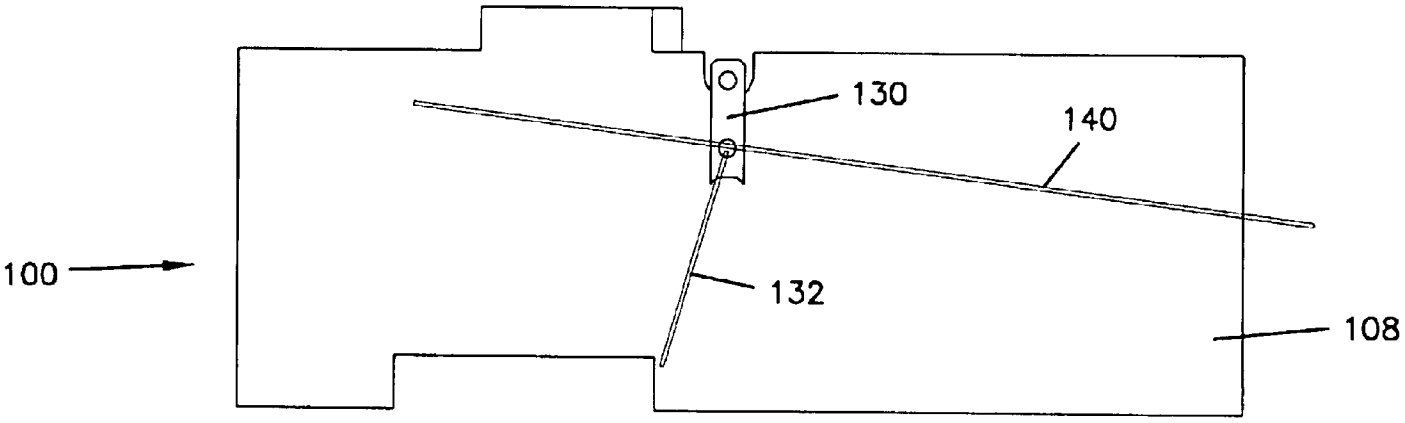
FIG. 8 is a side view of a full block according to the principles of the invention.
Figure 9:
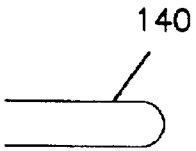
FIG. 9 is a view of a piece of rebar used to form a lifting mechanism in the back surface of a full block according to the principles of the invention.
Figure 10:
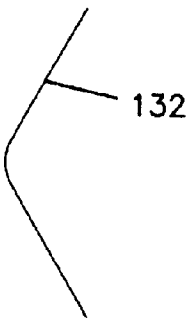
FIG. 10 is a view of a piece of rebar used to form a portion of a lifting mechanism in the top surface of a full block according to the principles of the invention.
Figure 12:
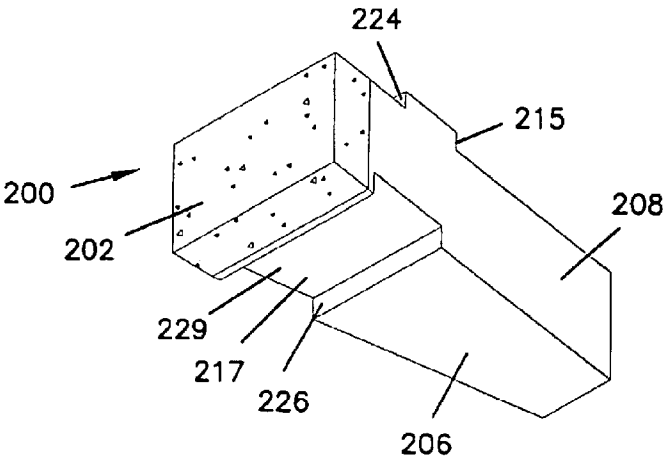
FIG. 12 is a lower perspective view of a half block according to the principles of the invention.

In a preferred embodiment shown in FIG. 8, the embedded lifting mechanism comprises an anchor 130 having a V-shaped piece of rebar 132 running almost from first side surface 108 to second side surface 110. An anchor such as a P-96 Fleet-Lift two-hole anchor from Dayton/Richmond Concrete Accessories may be used. A hook or ring clutch (not shown) may then be used for lifting the block.

It is also desired that the blocks of this invention include a lifting mechanism on the back surface of the block for lifting the block out of the molding machine as will be understood more clearly later in the discussion of the molding machine. Such a lifting mechanism on the back surface of the block can be any type of device secured to the block in such a way that it can withstand the weight of lifting the block.

In a preferred embodiment shown in FIG. 8, the rebar 140 is used as the lifting mechanism on the back surface of the block 100. Rebar 140 is a U-shaped piece of rebar that is formed in the block with the U-shaped portion of the rebar 140 extending outside the block and the other end of the rebar 140 extending at an upward angle in the block toward the top surface of the block.

Now we turn to a discussion of half blocks. A half block has a front surface, first and second side surfaces, top and bottom surfaces, and a back surface. The front surface of a half block has a width from first side surface to second side surface that is approximately half the width of a full block.

Except for the fact that a half block is generally half the width of a full block, the definitions of a front surface, first and second side surfaces, top surface, bottom surface and back surface of a half block are the same as defined above with respect to the full block.

The tongue set of a half block protrudes from the top surface of the block. A tongue set for a half block is one or more protrusions or tongues from the top surface of the block. The tongue set of a half block must fit within a groove of an overlying block wherein such overlying block might be a full block, top block or corner block. The highest protrusion of a tongue set of a half block must be no higher than the depth of a groove in an overlying block. In this way, an overlying block may be placed onto a lower block with the tongue set of the lower block positioned within the groove of the upper block.

A tongue set of a half block includes a front-facing surface set and a rear-facing surface set. A front-facing surface set is the surface of the tongue set nearest to the front surface of the block. A front-facing surface set is one or more front-facing surfaces. A front-facing surface is a surface of a tongue that faces the front surface of the block. That is, any point on a surface of the tongue belongs to the front-facing surface of that tongue when a line normal to the surface at that point would cross the front surface of the block. A front-facing surface set of a half block can be any shape, including but not limited to a planar surface and a curved surface or a set of planar and/or curved surfaces.

A rear-facing surface set of a half block is one or more rear-facing surfaces. A rear-facing surface of a half block is the surface on a tongue that faces the back surface or the first or second side surfaces of the full block. That is, any point on a surface of the tongue belongs to the rear-facing surface when a line normal to the surface at that point would cross the rear surface or the first or second side surfaces of the full block.

A rear-facing surface of a half block pursuant to the present invention may include a curved section. A curved section is a nonlinear section. A curved section will typically be a portion of a circle having a radius. However, a curved section does not have to be a perfect circle and could be, for example, a portion of an oval or other noncircular curve. The apex of a curved section is the point on the curved section that is furthest from the front face of the half block.

In a preferred embodiment of a half block, the rear-facing surface set includes only one curved section. In a preferred embodiment the single curved section of the rear-facing surface is convex in shape when viewed from the back surface of the block.

The radius of a curved section that is noncircular is defined as the effective radius, which is defined as the radius of a circle whose second derivative (calculus) is the same as the second derivative of the curved section taken at the apex of the curved section.

FIGS. 11–14 illustrate a preferred embodiment of a retaining wall half block pursuant to the principles of this invention. Retaining wall half block 200 includes front surface 202 that is generally planar but that also includes indentations, bumps and texture for providing ornamentation. Retaining wall half block 200 includes top surface 204 and bottom surface 206. In this preferred embodiment, top surface 204 and bottom surface 206 are generally planar with the exceptions of the tongue, groove and lifting mechanism. Retaining wall half block 200 includes first and second side surfaces 208 and 210. First and second side surfaces 208 and 210 are planar. Half block 200 also includes back surface 205.

Half block 200 includes tongue set 214 on its top surface 204. Tongue set 214 is made up of tongue 216. Tongue 216 is a single protrusion raised above the planar top surface 204. Half block 200 also includes groove 217 extending from first side surface 208 to second side surface 210 in bottom surface 206.

In a preferred embodiment, tongue 216 includes a rear-facing surface 215 that includes a curved section 218. The tongue 216 also includes front-facing surface 224 that is planar.

Groove 217 is defined by front-facing surface 226, rear-facing surface 228, and groove surface 229.

Figure 14:
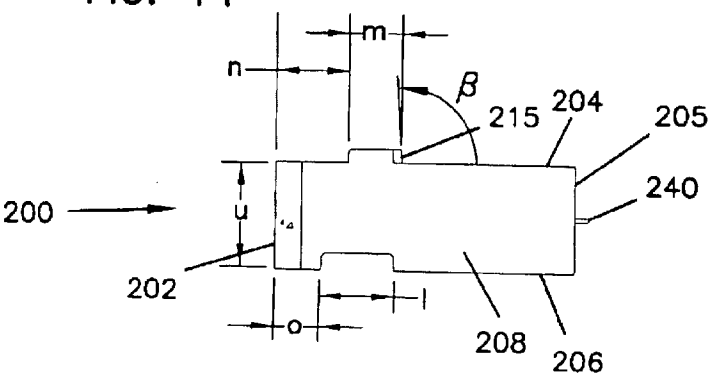
FIG. 14 is a side view of a half block according to the principles of the invention.
Figure 11:
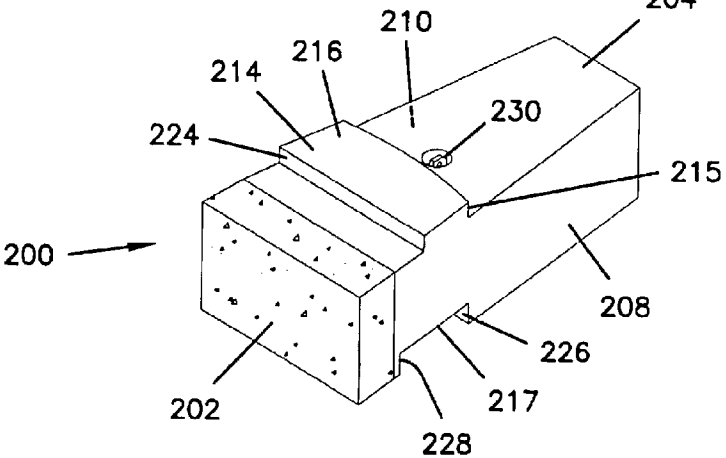
FIG. 11 is an upper perspective view of a half block according to the principles of the invention.
Figure 13:
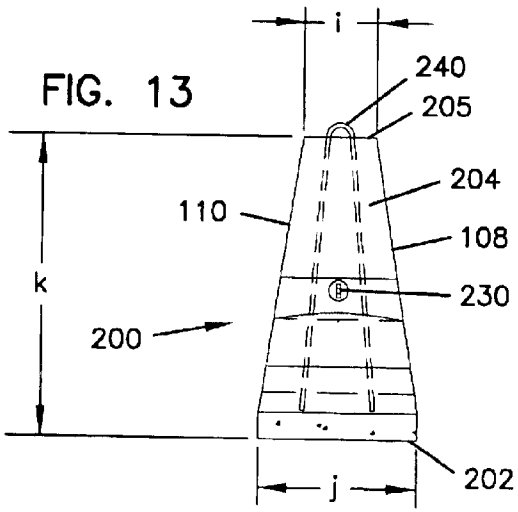
FIG. 13 is a top view of a half block according to the principles of the invention.
Figure 16:
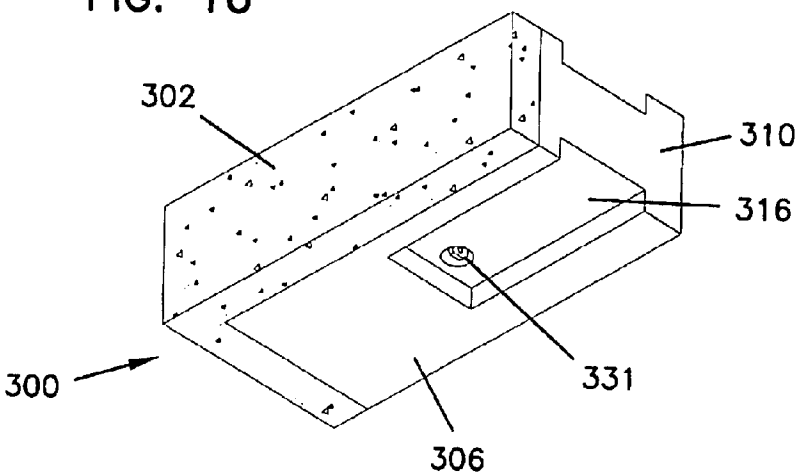
FIG. 16 is a lower perspective view of a corner block according to the principles of the invention.
Figure 15:
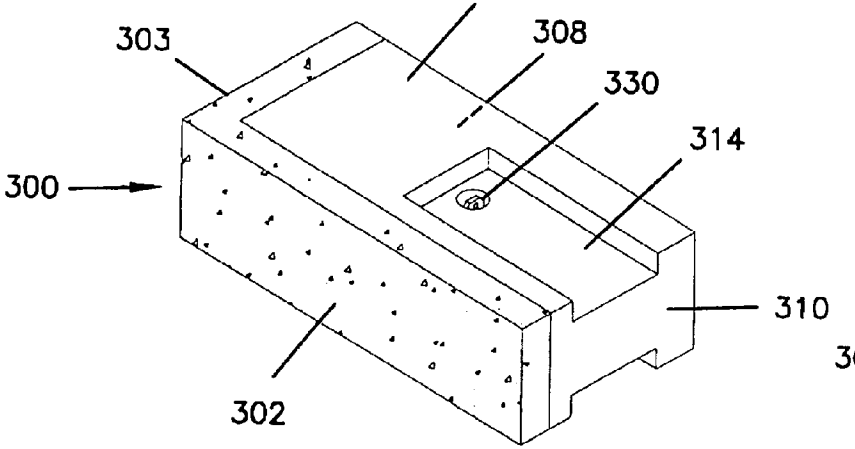
FIG. 15 is an upper perspective view of a corner block according to the principles of the invention.
Figure 18:
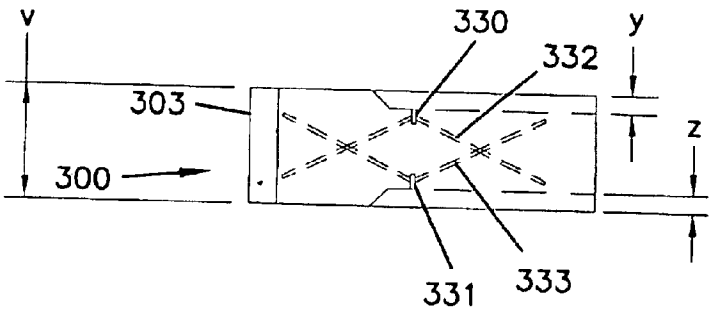
FIG. 18 is a side view of a corner block according to the principles of the invention.

Turning now to FIG. 14, the angle $_\beta$ is the angle between the rear-facing surface set of the tongue set and the top surface of the block. The discussion above with regard to the angle $_\alpha$ relating to the full block applies here as well with regard to the angle $_\beta$ on the half block.

In a preferred embodiment, the angle $_\beta$ is between 90 degrees and 100 degrees. More preferably, the angle $_\beta$ is between 92 degrees and 96 degrees. More preferably still, the angle $_\beta$ is 94 degrees.

Preferably, the slope of the rear-facing surface set of the half block relative to the top surface is constant. That is, the angle $_\beta$ should not increase as you move up the rear-facing surface set toward the top of the tongue. A changing slope would increase the likelihood of the upper block sliding up on the lower block.

As noted with regard to the full block, in order to build a curved wall that is convex in its curvature, the first and second side surfaces of the block must be at an angle relative to the front of the retaining wall of less than 90 degrees. In a preferred embodiment shown in FIG. 13, the angle between the planar front surface 202 of the block 200 and the first side surface 208 is 81 degrees. Likewise the angle between the front surface 202 and the second side surface 210 is 81 degrees.

The half block 200 also includes a lifting mechanism embedded in its top surface 204. The embedded lifting mechanism comprises an anchor 230 having a V-shaped piece of rebar (not shown) running almost from first side surface 208 to second side surface 210.

As with the full block, it is desired the half blocks of this invention include a lifting mechanism on the back surface of the block for lifting the block out of the molding machine as will be understood more clearly later in the discussion of the molding machine. Such a lifting mechanism on the back surface of the block can be any type of device secured to the block in such a way that it can withstand the weight of lifting the block.

In a preferred embodiment shown in FIG. 14, the rebar 240 is used as the lifting mechanism on the back surface of the block 200. Rebar 240 is a u-shaped piece of rebar that is formed in the block with the u-shaped portion of the rebar 240 extending outside of the block and the other end of the rebar 240 extending at an upward angle in the block toward the top surface of the block.

It is also desired when building retaining walls with right angled corners to utilize a corner block. A corner block is a block having an ornamental face on two or more surfaces, wherein two of the two or more surfaces are at substantially a right angle to one another. A corner block has a first front surface and a second front surface perpendicular to the first front surface. There may be additional surfaces, planar or curved, that are part of the front surface. The first front surface is longer than the second front surface. The first and second front surfaces are generally flat but may include indentations, protrusions and other design markings to make them aesthetically pleasing. Corner blocks also include a first side surface opposite the first front surface and a second side surface opposite the second front surface. The first and second side surfaces may be shaped in any design that allows placement of adjacent blocks such that adjacent front surfaces can be aligned.

A corner block in accordance with the present invention includes a top surface and a bottom surface. The top and bottom surfaces are substantially planar to allow for stacking of blocks on top of the corner block. A corner block in accordance with the principles of the present invention also includes a first groove in the top surface and a second groove in the bottom surface. The first and second grooves must be shaped so as to receive a portion of a tongue set from a full block or half block pursuant to this invention.

A corner block in accordance with this invention will have a first front surface that is approximately twice as long as the second front surface. The first groove extends from the first side surface toward the second front surface, but ending prior to reaching the second front surface. The second groove extends along the bottom surface from the first side surface toward the second front surface but stopping prior to reaching the second front surface.

A lifting mechanism may be embedded in a corner block as was described with respect to the full block and half block more preferably, a lifting mechanism is embedded on each of the top and bottom surfaces of the block. The lifting mechanisms may be embedded in the corner block within the first and second grooves.

The corner blocks are stacked at the corner of a retaining block wall by placing the first front surface facing a first direction and the second front surface facing a second direction, and then placing the next overlying corner block in such a way that the first front surface (which is the longer surface) facing the second direction and the second front surface facing the first direction. This change of orientation of the corner block from a first layer to the next above overlying layer requires that the blocks be flipped relative to one another. In other words, the top surface of a first corner block would be facing up while the top surface of the next overlying corner block would be facing down. These orientations of overlying corner blocks would of course be put in place next to adjacent full blocks.

FIGS. 15–18 illustrate a preferred embodiment of a retaining wall corner block pursuant to the principal of this invention. Retaining wall corner block 300 includes first front surface 302 and second front surface 303 that are generally planar but that also include indentations, bumps and texture for providing ornamentation. Retaining wall corner block 300 includes top surface 304 and bottom surface 306. In this preferred embodiment, top surface 304 and bottom surface 306 are generally planar with the exception of grooves and lifting mechanisms. Retaining wall corner block 300 includes first and second side surfaces 308 and 310. First and second side surfaces 308 and 310 are planar.

Corner block 300 includes first groove 314 on its top surface 304. Corner block 300 also includes a second groove 316 in the bottom surface 306. The grooves 314 and 316 must be shaped for receipt of a tongue set or a portion of a tongue set from an underlying full block or half block.

The corner block 300 also includes a lifting mechanism embedded in the groove 314 and a second lifting mechanism embedded in the second groove 316. It is noted that depending on the exact shape and size of the grooves 314 and 316, the first and second lifting mechanisms could be embedded in the top and bottom surfaces 304 and 306, respectively, instead of within the grooves. The first and second embedded lifting mechanisms comprise anchors 330 and 331, respectively, as well as v-shaped pieces of rebar 332 and 333, respectively. The orientations of the rebar 332 and 333 can be seen in FIG. 18.

Figure 17:
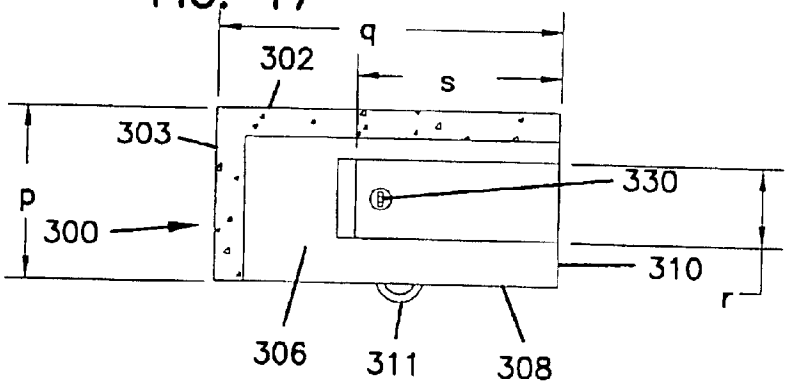
FIG. 17 is a bottom view of a corner block according to the principles of the invention.
Figure 20:
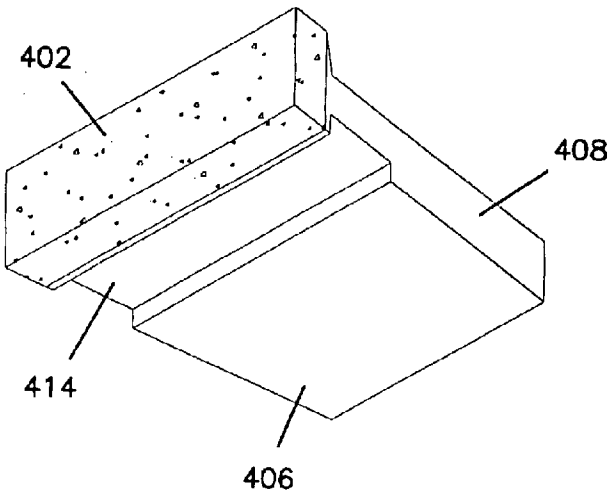
FIG. 20 is a lower perspective view of a top block according to the principles of the invention.
Figure 19:
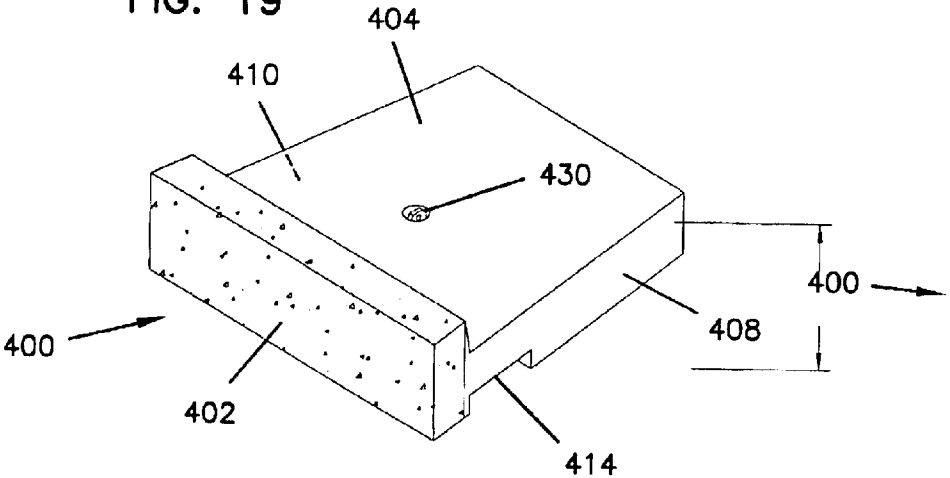
FIG. 19 is an upper perspective view of a top block according to the principles of the invention.
Figure 22:
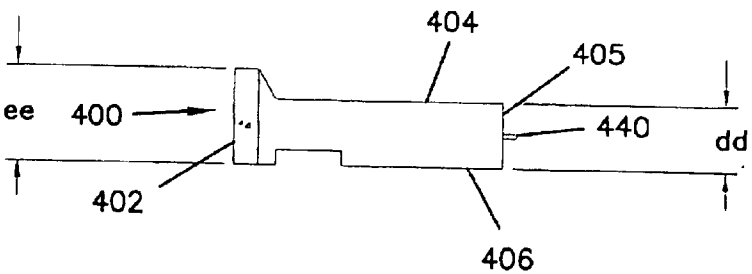
FIG. 22 is a side view of a top block according to the principles of the invention.
Figure 21:
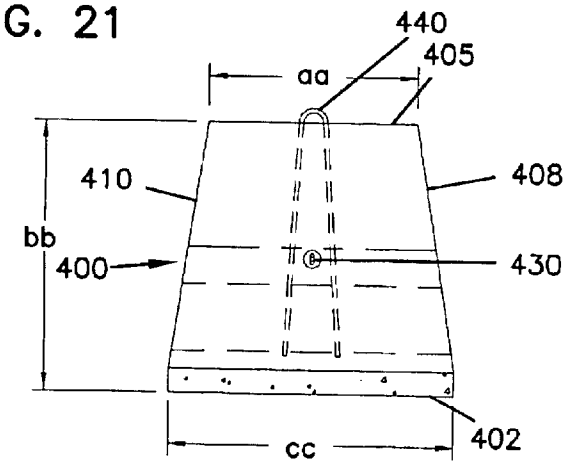
FIG. 21 is a top view of a top block according to the principles of the invention.

In a preferred embodiment shown in FIG. 17, the rebar 311 is used as the lifting mechanism on surface 308 of the block 300. Rebar 311 is a generally U-shaped piece of rebar that is formed in the block with the U-shaped portion extending outside of the block.

It is also desired to have a top block for capping a retaining wall. A top block differs from a full block in that it has a top surface that does not include a tongue set and that is slightly lower than the top of the front surface. The lowered top surface serves the function of allowing placement of dirt or gravel or grass or other covering on top of the top surface such that it will line up horizontally with the top of the front surface. A top block has a first side surface and a second side surface wherein the first and second side surfaces are shaped so as to accommodate adjacent blocks so that adjacent front surfaces can be aligned without a gap between them. A top block includes a bottom surface the same as for a full block including a groove as discussed above with regard to a full block.

FIGS. 19–22 illustrate a preferred embodiment of a retaining wall top block pursuant to the principals of this invention. Retaining wall top block 400 includes front surface 402 that is generally planar but that also includes indentations, bumps and texture for providing ornamentation. Retaining wall top block 400 includes top surface 404 and bottom surface 406. In this preferred embodiment, top surface 404 and bottom surface 406 are generally planar with the exceptions of the groove and the lifting mechanism. Retaining wall top block 400 includes first and second side surfaces 408 and 410. First and second side surfaces 408 and 410 are planar. Retaining wall top block 400 also includes back surface 405.

Top block 400 includes groove 414 defined in its bottom surface 406. Groove 414 is designed to interact with the tongue set of an underlying block or blocks. This interaction between the groove 414 and the underlying tongue set of an underlying block is the same as the interaction described above with respect to the full block.

As noted with regard to the full block, in order to build a curved wall that is convex in its curvature, the first and second side surfaces of the block must be at an angle relative to the front of the retaining wall of less than ninety degrees. In a preferred embodiment shown in FIG. 21, the angle between the planar front surface 402 of the block 400 and the first side surface 408 is 81 degrees. Likewise, the angle between the front surface 402 and the second side surface 410 is 81 degrees.

The top block 400 also includes a lifting mechanism imbedded in its top surface 404. The embedded lifting mechanism comprises an anchor 430 having a v-shaped piece of rebar 432 running almost from first side surface 408 to second side surface 410.

Top block 400 includes u-shaped rebar 440 extending out of the back surface of the block for the same purpose as rebar 140 on the full block 100.

A half top block not shown in the Figures is also utilized in this invention. A half top block is the same as a top block except that it is of only half the width (across its front surface) of the top block.

When building retaining walls, it is common to use a geogrid or set of cables behind the wall that extend into the earth to support the wall. Use of a geogrid requires a significant amount of excavation of the area behind the wall. One advantage of the current blocks due to their size and weight is that for walls approximately 10 feet or less in height, a geogrid is not required.

It is also noted that when geogrid is utilized with the blocks of this invention, the blocks can be made smaller than the full sizes shown in the embodiment of the drawings. The full block for example, can be made to a depth shown by reference letter c in FIG. 5. Likewise, the other blocks can be modified to the same depth as the full block.

It is also noted that in a one embodiment, the moldable concrete used to form the blocks is a wet cast concrete with pressure of approximately 3,000 pounds per square inch. Of course, this pressure is not limiting to the scope of the invention as set forth in the claims.

In one embodiment a single full block weighs approximately 2600 pounds.

In one embodiment the radius of a curved section of a tongue set of a full block is 46.5 inches. Likewise, in one embodiment, the curved section of a tongue set of a half block is 46.5 inches. These dimensions are provided as examples and in no way should they be construed as being limiting to the scope of the protection provided in the claims.

In association with one embodiment of the various blocks, particular dimensions will now be provided in the below table. These dimensions are in no way limiting to the scope or breadth of the invention disclosed herein. Many other dimensions, shapes, and configurations are within the scope of this invention. The dimensions are provided in inches.

| Reference letter from Drawing Figures | Dimension (inches) |
|---|---|
| a | 48 |
| b | 45 |
| c | 24 |
| d | 35 |
| e | 10.875 |
| f | 8 |
| g | 10.875 |
| h | 7 |
| i | 11 |
| j | 24 |
| k | 45 |
| l | 10.875 |
| m | 8 |
| n | 10.875 |
| o | 7 |
| p | 24 |
| q | 48 |
| r | 10.875 |
| s | 28.5 |
| t | 16 |
| u | 16 |
| v | 16 |
| w | 2.5 |
| x | 2 |
| y | 2.5 |
| z | 2.5 |
| aa | 35 |
| bb | 45 |
| cc | 48 |
| dd | 11 |
| ee | 16 |

Block Forms

Block forms for molding blocks such as the blocks described above will now be described. The block forms of this invention are not intended to be limited to forming the blocks described above.

One possible use of a block form is for utilizing moldable returned concrete such as wetcast concrete. Returned concrete is concrete that is left over after a concrete pouring job is completed. This left over concrete can be returned to the mixing plant or to some other location and poured into a block form instead of merely dumping the concrete on the ground to be wasted. The use of returned concrete is one exemplary use of the block forms of this invention. However, the block forms of this invention are not limited to being used with returned concrete.

A block form pursuant to the invention includes four walls and a bottom. The four walls and bottom form an enclosure into which moldable concrete can be poured and allowed to harden. Once the concrete is hardened, the block must be removed from the block form. Removal of the block from the block form can be accomplished in many different ways. For example, the four walls can be removed and the block lifted away from the block form.

The block form includes a supporting structure that supports the four walls and the bottom. The supporting structure, four walls and bottom must be strong enough to support the weight of the poured moldable concrete. For example, the supporting structure, four walls, and bottom may be made of steel. However, other materials of sufficient strength may be used.

In a one embodiment of the present invention, one or more of the four walls are hinged doors. The one or more hinged doors are hingedly connected to the supporting structure. A hinged door is a wall that is capable of at least partial rotation about an end. The rotation of a hinged door may be limited to a certain range of movement.

Hinged doors have at least two positions. Hinged doors have a molding position, which is the position of the hinged door that forms the enclosure for forming the block. The hinged door must be in the molding position when the moldable concrete is poured into the block form. Hinged doors have an open position that is different than the molding position. The open position is a position in which the hinged door is rotated away from the molded block. Once the moldable concrete is substantially hardened, the hinged door may be moved from its molding position to its open position to allow for easier removal of the block from the block form.

Hinged doors may also include a third position in which the door is rotated even further than the open position such that the end of the hinged door opposite the hinge contacts the floor or ground. A safety stop to be described more fully below may be removed to allow the hinged door to move from the open position to this third or fully opened position.

In a preferred embodiment, the hinged doors are removable. Removability of the doors allows for easy repair of damaged doors and/or replacement. Furthermore, a hinged door with a particular shape on its inside wall surface may be replaced by another hinged door having a different shape on its inside wall surface. In this way, different shaped blocks may be formed.

Figure 23:
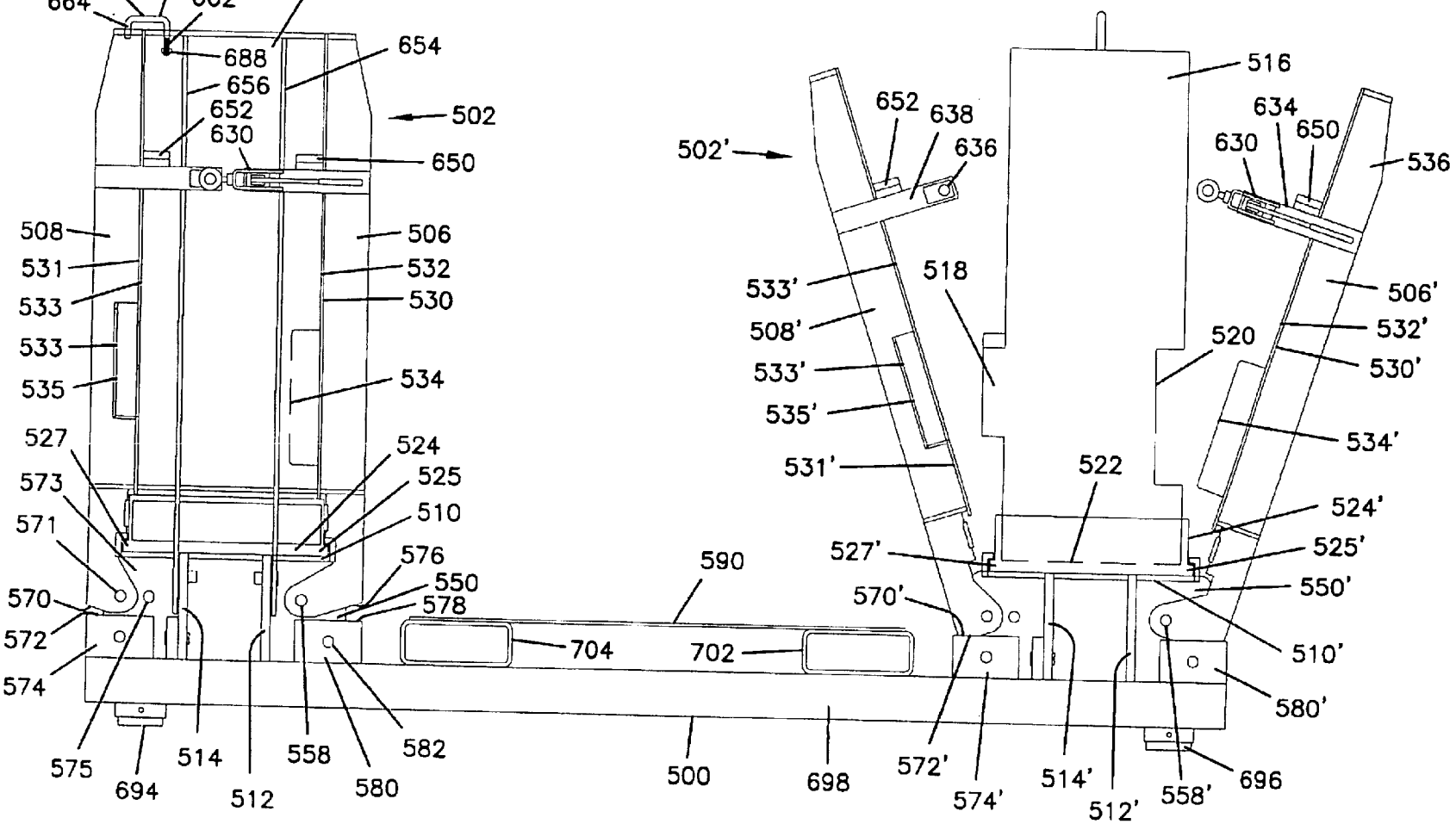
FIG. 23 is a front view of two full block forms on a single supporting structure according to the principles of the invention.

A preferred embodiment of a block form for forming a full block in accordance with the principles of this invention is shown in FIGS. 23–27. FIG. 23 actually shows one embodiment of a supporting structure 500, and first block form 502 and a second block form 502' supported by the supporting structure 500. It is noted that when two or more block forms are placed on a single supporting structure, the block forms may be identical to one another or they may have differences. For example, one block form on the supporting structure could be for forming full blocks and another block form on the same supporting structure could be configured for forming corner blocks. Alternatively, both block forms on a single supporting structure could be for forming full blocks as shown in FIG. 23. It is also noted, however, that this invention is not limited to multiple block forms on a supporting structure. A single block form on a much smaller supporting structure is certainly within the scope of this invention.

Block form 500 has four hinged doors that are shown in FIG. 23 in their molding position. End hinged door 504 and first side hinged door 506 and second side hinged door 508 can be seen in FIG. 23. A second end hinged door 509 that is oppositely disposed from first end hinged door 504 is not shown in FIG. 23 but can be seen in FIGS. 24–27. Bottom 510 is supported by the supporting structure 500 through plates 512 and 514.

Block form 502' is shown with its first end hinged door removed from the block form and the first side door 506' and second side door 508' positioned in the open position. A full block 516 including tongue 518 and groove 520 is shown situated on bottom 510'. The front surface 522 of the full block is shown facing down into a face form 524' supported by bottom 510' as will be described in more detail below.

In a preferred embodiment of the block form, the hinged door includes a molding panel having a molding surface that is the wall surface that contacts the moldable concrete directly. The molding panel is strengthened by two or more gussets, which are generally perpendicular to the molding panel. Two of the two or more gussets extend below the lower edge of the molding panel to form hinge arms that are the portion of the hinged door hingedly connected to the supporting structure.

One or more of the hinge arms on a hinged door include a stop engaging surface which is the surface that makes contact with a safety stop to prevent the hinged door from rotating beyond the open position. A stop engaging surface of a hinge arm is any shape that can interact with a safety stop to prevent further rotation of the hinge door. For purposes of this invention, the stop engaging surface is a surface lying directly above a safety stop such that rotation of a hinge door from a molding position to an open position results in contact between the stop engaging surface and the safety stop.

The molding surface of a molding panel of a block form may be shaped in such a way as to create tongue and groove sets on the block being formed. For example, to arrive at the full block described earlier in this application, a first door includes a protrusion on its inside wall surface to result in formation of the groove in the bottom surface of the block. A second and opposite door on the block form includes a cutout in the shape of the tongue set required on the top surface of the block.

The first hinged door 506 as shown in FIG. 23 includes a molding panel 530 having a molding surface 532. Since the block form 502 is configured for forming full blocks of the configuration disclosed earlier in this application, the molding surface 532 is shaped generally planar but with a protrusion 534 for forming a groove in the bottom surface of the block. The protrusion 534' is also illustrated on block form 502' for forming groove 520. A protrusion in the molding surface of a molding panel can be any shape or configuration desired for the shape and configuration of the block being formed. The block form of this invention is not limited to the formation of the retaining wall blocks discussed above. Other block shapes including tongue and groove shapes may be manufactured using the block forms of this invention.

The second side hinged door 508 as shown in FIG. 23 includes a molding panel 531 having a molding surface 533. Since the block form 502 is configured for forming full blocks of the configuration disclosed earlier in this application, the molding surface 533 is generally planar but with a recess 535 for forming a tongue set in the top surface of the block. The recess 535' is also illustrated on block form 502' for forming tongue set 518. A recess in the molding surface of a molding panel can be any shape or configuration desired for the shape and configuration of the block being formed.

Figure 24:
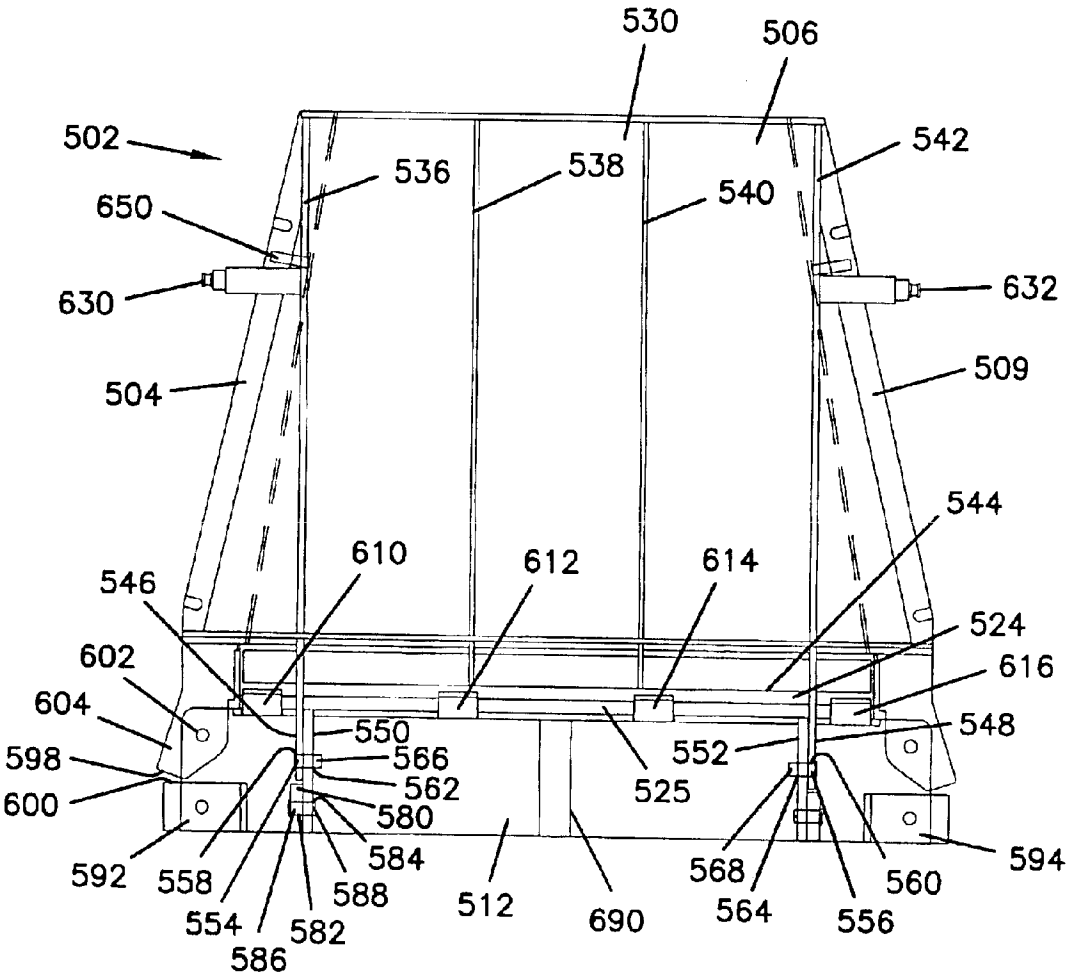
FIG. 24 is a right side view of a full block form according to the principles of the invention.

FIG. 24 is a side view of the block form 502 without the supporting structure 500. As shown in FIG. 24, the molding panel 530 is supported by first gusset 536, second gusset 538, third gusset 540 and fourth gusset 542. Gussets are generally perpendicular to the molding panel and provide structural support of the molding panel. More or fewer gussets than shown in the embodiments of the Figures may be utilized depending on the weight that the door must withstand which depends on the amount of moldable concrete used. Furthermore, different size and shaped gussets may be used.

First gusset 536 and fourth gusset 542 extend below the bottom edge 544 of the molding panel 530 to form hinge arms 546 and 548. Hinge arms 546 and 548 are hingedly and removably connected to the supporting members 550 and 552 of the supporting structure 500 about pins 554 and 556 respectively. Pins 554 and 556 are positioned within holes 558 and 560 in hinge arms 546 and 548 and adjacent holes 562 and 564 in the supporting members 550 and 552 respectively. Smaller pins 566 and 568 prevent the pins 554 and 556 respectively from sliding out of the holes in the hinge arms and supporting members.

The pins 554 and 556 can be removed from the holes in the hinge arms and supporting members by removing the smaller pins 566 and 568 and then sliding the pins 554 and 566 out of their respective holes. This may be done to remove the door from the supporting structure for repair or replacement.

In a preferred embodiment of the block form of this invention, the lower edges of the hinge arms are designed to interact with a safety stop to prevent the hinged door from rotating beyond the open position wherein the hinged door could fall on a person and injure them.

The hinge arms of one embodiment of the invention include an edge having a stop engaging surface that is a surface that is positioned directly above a stopping surface of a safety stop when the hinged door is in its molding position.

A safety stop is a member having a stopping surface that is positioned directly below a hinge arm of a hinged door. That is, a stopping surface and a stop engaging surface can be identified when there is a point on each that can be connected by a vertical line.

A hinged door may only require one safety stop per door. If the hinged door can be fully and safely supported with a safety stop on one hinge arm then only one safety stop is necessary. Alternatively two or more safety stops may be used in conjunction with two or more hinge arms on a hinged door.

As shown in FIG. 23, hinged door 508 includes stop engaging surface 570 positioned over stopping surface 572 of safety stop 574. Likewise, hinged door 506 includes stop engaging surface 576 positioned over stopping surface 578 of safety stop 580. As the hinged doors are rotated from the molding position shown in block form 502 to the open position shown in block form 502', it can be seen that the stop engaging surface 570' contacts the stopping surface 574' and prevents the hinged door 508' from rotating any further.

It is noted that in the embodiment shown in the Figures, the point of hinging connection between door 506 and the supporting member 573 is positioned differently from the position of the hinging point at hole 558 for the hinged door 508. These differences account for different weights of the doors 506 and 508. Extra holes may be provided such as hole 575 to allow interchangeability of different doors.

The safety stops may be removable from the supporting structure for easy removal of the hinged doors. Removal of safety stops is accomplished by the use of a removable pin to hold the safety stop in place.

For example, safety stop 580 includes a hole 582 that matches up with a hole 584 in the supporting member 550. Pin 586 is inserted into the holes 582 and 584. A smaller pin 588 is slidably received by a smaller hole in the end of pin 586 to retain pin 586 in place. By removing smaller pin 588, pin 586 may be removed to allow removal of safety stop 580.

The above-mentioned feature of removable safety stops may be repeated for all the safety stops on the block form.

In one embodiment however, it may be desirable to prevent removal of the safety stops facing platform 590. Platform 590 is a location for an operator of the block form to stand. Because of the concern that the doors facing the platform could fall inward and crush or otherwise injure the operator it may be desirable to prevent removal of the safety stops 580 and 574' by welding them in place.

The safety stops 592 and 594 associated with end hinged doors 504 and 509 respectively are shown in FIG. 24. Hinge arm 604 includes stop engaging surface 598 for engaging with stopping surface 600 of safety stop 592. Likewise, the other hinge arms on the block form have associated stop engaging surfaces for engagement with a stopping surface of a safety stop.

End hinged doors 504 and 509 are also removable doors. For example, the hole 602 in the hinge arm 604 and an adjacent hole in the supporting member 512 slidably receive a pin as described above with regard to the side hinged doors 506 and 508. The pins associated with hinged doors 504 and 509 are not shown in the Figures but are the same as the pins described above for removably securing the hinged doors to the supporting structure.

A face form was briefly mentioned above. The face form itself as well as its interaction with the block form will now be described.

A face form is a shaped member for forming the aesthetically pleasing front surface of a block. A face form may have any shape or design that creates the desired front surface of the block being formed. A face form may be utilized to form blocks with one front surface or additionally face forms may be used to form blocks with multiple front surfaces such as corner blocks. The face form is placed at least partially on the bottom of a block form.

A face form in accordance with the principals of this invention includes a bottom surface textured to the desired ornamentation, and first and second end walls and first and second side walls connected with the bottom surface of the face form to form a partial enclosure for containing the moldable concrete. A face form includes a first anchor rail projecting from one of the first end wall and first side wall and a second anchor rail projecting from one of the second end wall and second side wall. An anchor rail is one or more protrusions to the outside of the wall that may be slidably mated with a block form.

Figure 26:
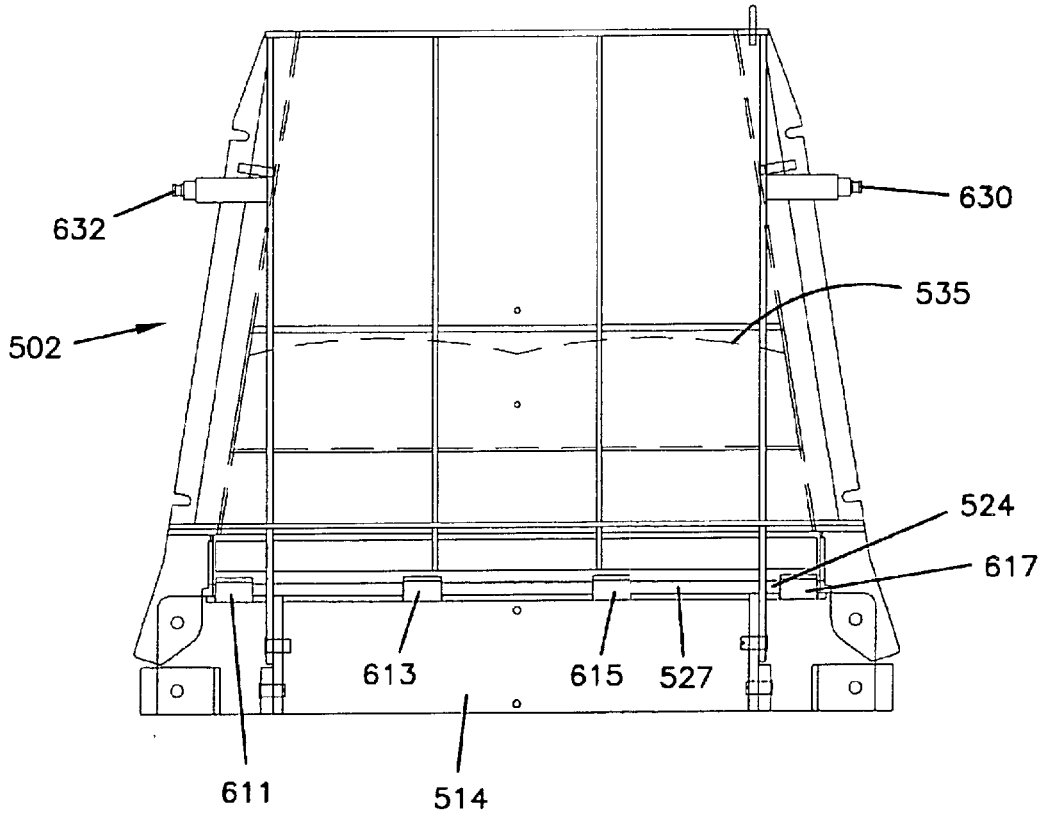
FIG. 26 is a left side view of a fill block form according to the principles of the invention.
Figure 27:
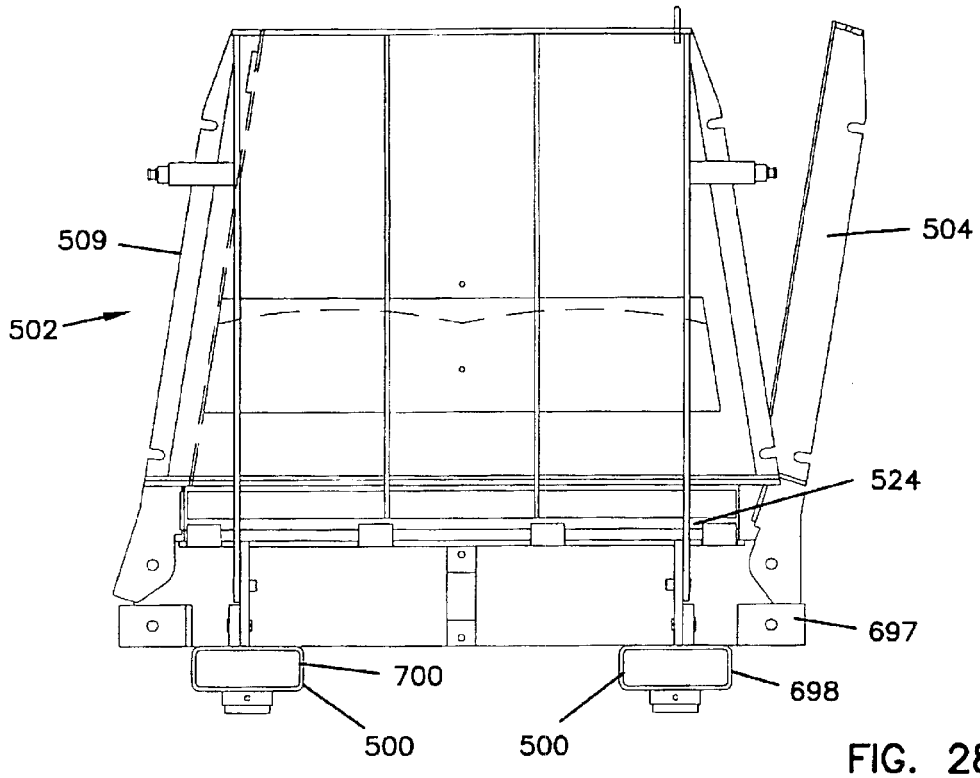
FIG. 27 is a left side view of a full block form with one hinged door in its open position and also showing the supporting structure according to the principles of the invention.
Figure 28:
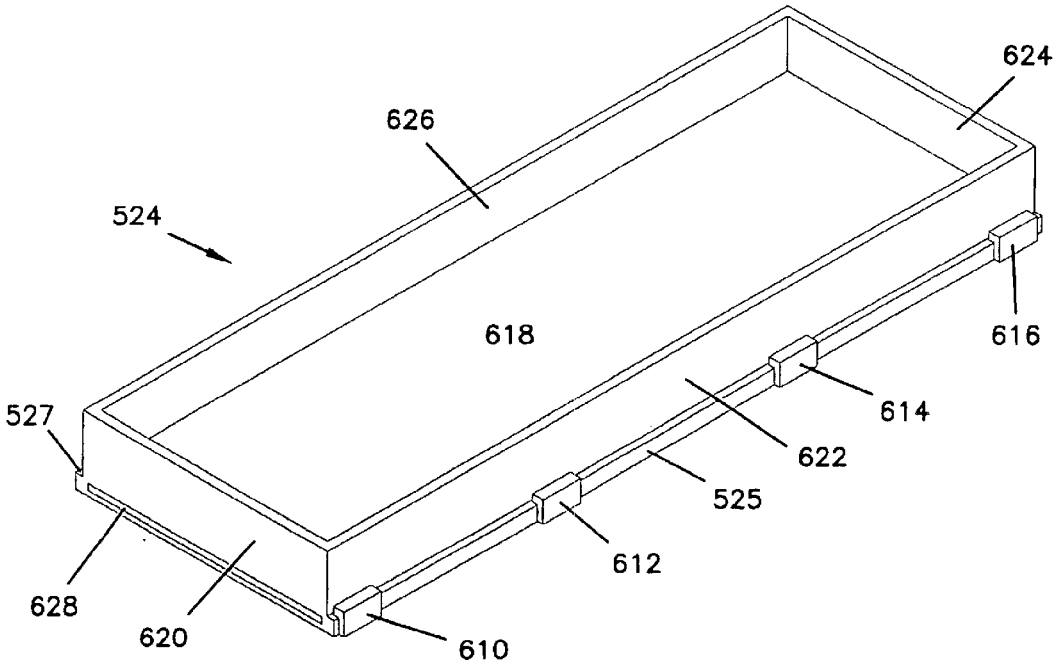
FIG. 28 is a perspective view of a face form according to the principles of the invention.

One embodiment of a face form is shown in FIGS. 23–28 as face form 524. FIG. 28 shows face form 524 along with portions of anchor rail clamps 610, 612, 614 and 616 that are not part of the face form but rather are part of the block form as will be described.

Face form 524 includes a bottom surface 618, a first end wall 620, first side wall 622, second end wall 624, and second side wall 626. The walls and the bottom surface are joined or formed together such that they form a volume for receiving moldable concrete without the moldable concrete flowing through or between the bottom surface and the four walls.

A face form may be made of any material that is capable of being formed into the desired shape and that prevents the moldable concrete from flowing through the walls and bottom surface. In one embodiment, the face form 524 is made of urethane, which is easily formed to the desired shape.

A face form must be held in place at the bottom of the block form when the hardened retaining wall block is removed from the block form. It is desired to be able to easily remove the face form from the block form for cleaning, repair, or replacement of the face form. Additionally, it is desired to remove the face form from the block form and rotate it 180 degrees in the horizontal plane and place the face form back in the block form in this "flipped" configuration. This flipping of the face form allows the operator to invert the shape and ornamentation on the front surface of the block as compared to an earlier block done prior to the flipping of the face form.

Face form 524 includes anchor rail 525 extending out from first side wall 622. Anchor rail 527 extends out from second side wall 626. Anchor rails 525 and 527 are rectangular shaped protrusions.

A block form of a preferred embodiment of the invention includes anchor rail clamps designed for sliding engagement with anchor rails of a face form. An anchor rail clamp is a member attached to the bottom of the block form or to the supporting structure having a geometry into which the anchor rails of a face form may be received such that when engaged, the anchor rail clamps prevent the face form from being lifted vertically off the bottom of the block form.

In a preferred embodiment, shown in FIGS. 23–28, anchor rail clamps 610, 612, 614 and 616 are inverted L-shaped steel members welded to the bottom 510 of the block form 502. It should be appreciated that the number of anchor rail clamps can be modified. Furthermore, the dimensions including the length of the anchor rail clamps may be modified as long as they perform the function of holding the face form in place when the block is lifted out of the block form.

Anchor rails 525 and 527 are slidably held in place adjacent to bottom 510 by anchor rail clamps 610, 612, 614, and 616 on the first side of the face form as shown in FIG. 24 and by anchor rail clamps 611, 613, 615 and 617 on the second side of the face form 524 as shown in FIG. 26. As the hinged doors are moved from their open position to the molding position, the doors are designed to be positioned adjacent the face form 524. Therefore, slidable removal of the face form from the block form is typically performed with the hinged doors in their open position. In the configuration shown in the preferred embodiments of the Figures, one of the end hinged doors must be either removed or rotated beyond the open position with the safety stop removed for removal of a face form. The block form 502' in FIG. 23 illustrates the position of the doors when slidably removing or inserting of the face form 524 is taking place. Note that first end hinged door 504' is not shown on this block form 502' because it has been removed from the block form in this Figure.

Face form 524 also includes a stiff member 628 in the bottom surface 618. Stiff member 628 is a planar plate running from first end wall 620 to second end wall 624 and first side wall 622 to second side wall 626. The stiff member in the bottom surface is any structural member that provides sufficient strength in conjunction with the rest of the bottom surface to prevent the face form from significant deformation during removal of the block from the block form. Stiff member 628 is plywood. The stiff member could be many different materials, such as, but not limited to, steel, stiff plastic, fiberglass, or some composite material. If the material used for the face form 524 is a material that is stiff such that it doesn't significantly deform when the block is removed, then a stiff member is not required in the face form.

Figure 29:
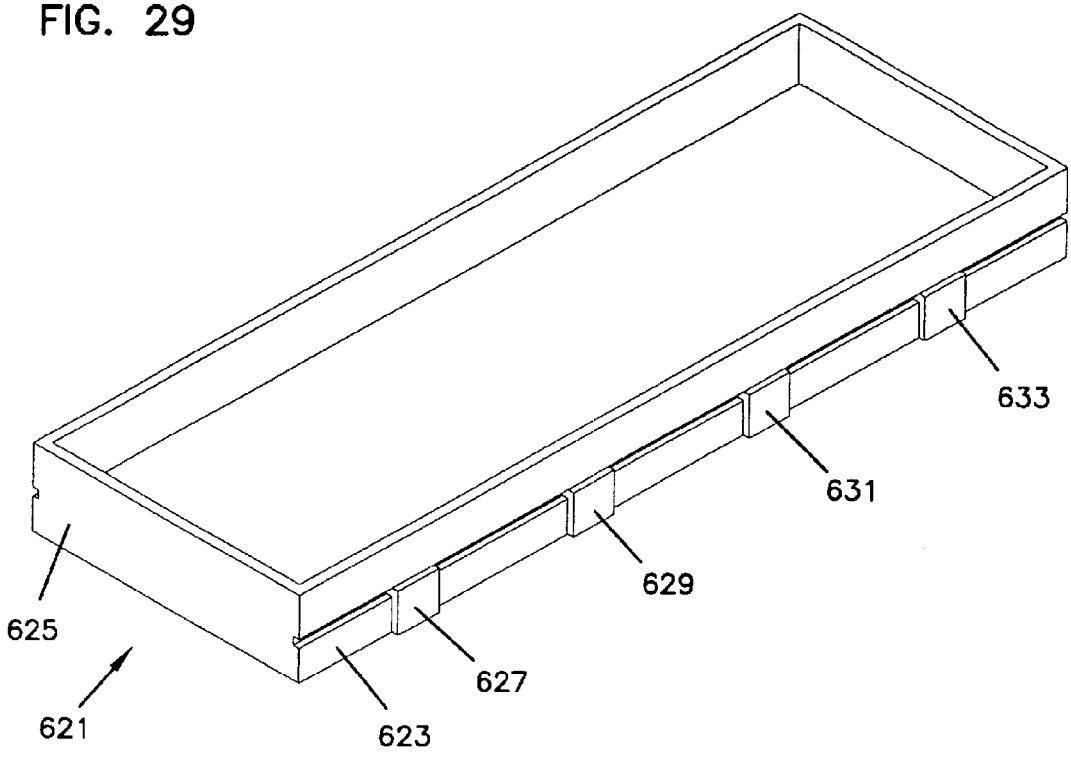
FIG. 29 is a perspective view of an alternate embodiment face form according to the principles of the invention.
Figure 30:
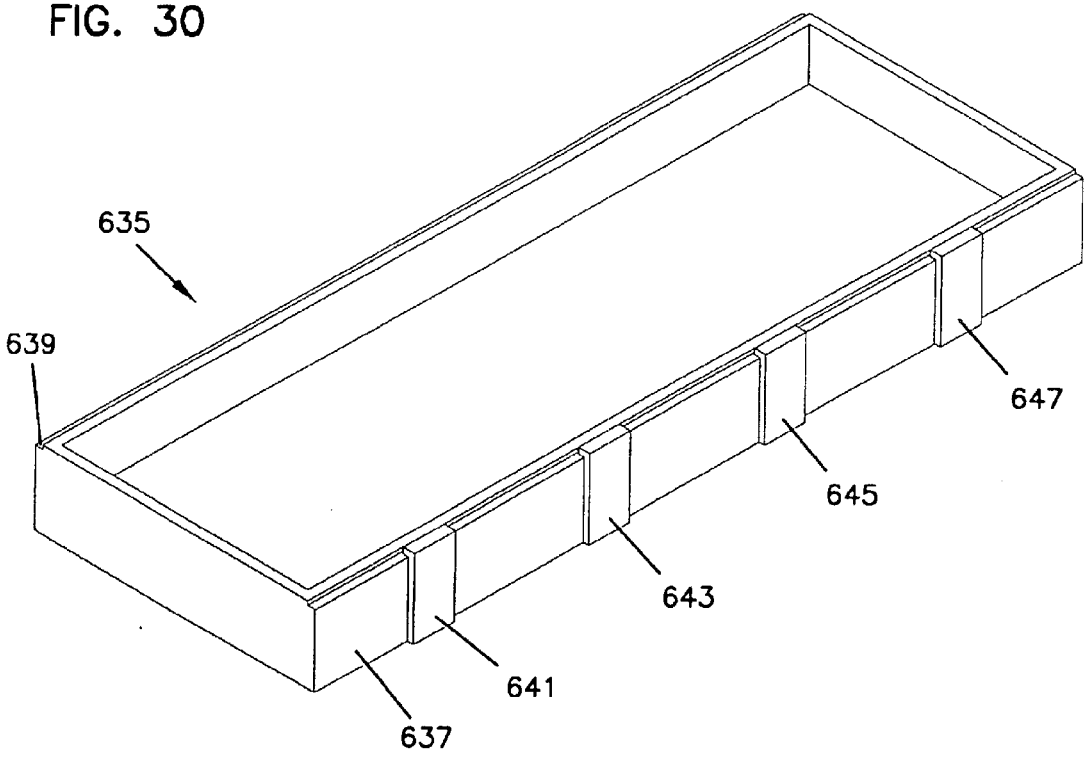
FIG. 30 is a perspective view of an alternate embodiment face form according to the principles of the invention.
Figure 32:
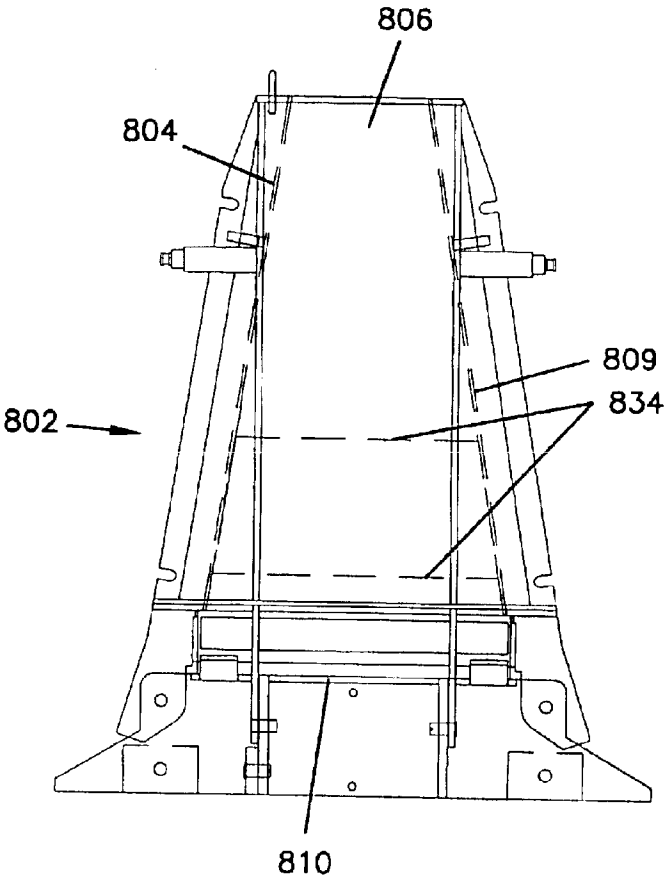
FIG. 32 is an end view of a half block form according to the principles of the invention.

FIGS. 29 and 30 illustrate a couple possible alternative embodiments to a face form in accordance with the principles of the present invention. These alternate embodiments should not be considered to be the only possible alternatives.

FIG. 29 illustrates face form 621 that includes first anchor rail 623 and second anchor rail 625. Anchor rail clamps 627, 629, 631 and 633 are not part of the face form 621 but would be attached to the block form.

FIG. 30 illustrates face form 635 that includes first anchor rail 637 and second anchor rail 639. Anchor rail clamps 641, 643 and 645 are not part of the face form 635 but would be attached to the block form.

It is desirable to have retaining wall blocks of different ornamentation on the front surface as opposed to all the blocks in a wall having identical ornamentation.

Therefore, the following method of this invention is of considerable advantage in forming different blocks with different front surface ornamentation without having to use a different block form. The unique method is to remove the face form from a first orientation in the block form and then provide it back into the block form in a second orientation. For example, the face form 524 can be slidably received into the block form in a first orientation in which the wall 624 is adjacent the end wall 509 of the block form 502. A second orientation is to have the wall 620 adjacent to the end wall 509 of the block form 502.

The above-mentioned method is not intended to be limited to slidable face forms. In fact the method could be utilized in a system with a bolt down face form, for example. Of course, the slidable face forms make the method even more attractive and efficient.

A locking mechanism must be attached to the block form to securely hold the hinged door in its molding position while the moldable concrete is being poured into the block form as well as during the hardening stage. A locking mechanism is any mechanism that retains the hinged door in its molding position during such steps.

In the embodiments shown in FIGS. 23–27, the locking mechanisms utilized are over-center clamps 630 and 632. Over-center clamps 630 and 632 of the embodiment shown in the Figures are 10 inch Concrete Form Clamps made by Best Metal Clamp. Over-center clamp 630 is attached to first arm 634 that is welded to first side hinged door 506. The keeper 636 of the over-center clamp 630 is attached to second arm 638 that is welded to the second side hinged door 508. Likewise, over-center clamp 632 is attached to third arm 640 that is welded to second side hinged door 608. The keeper 642 of the over-center clamp 632 is attached to the fourth arm 644 that is welded to the first side hinged door 506.

It is desired to have a pry point by which a crow bar or other similar device may be inserted to pry open the hinged doors after the moldable concrete has substantially hardened. Pry members 650 and 652 are welded to the first side hinged door 506 and second side hinged door 508 respectively. As can be seen in FIG. 23, when the doors are in their molding position, a space is created between the pry members 650 and 652 and the gussets 654 and 656 of the first end hinged door 504 respectively.

The pry members may be placed in any location where the necessary leverage may be obtained to pry the doors open. The pry members could be, for example, placed at a different height along the doors. Alternatively, the pry members could be placed on any of the other hinged doors.

A pry member can be any shape as long as a surface is provided that will allow a pry bar to press against the surface without undesirable slippage of the pry bar during the prying action.

Figure 42:
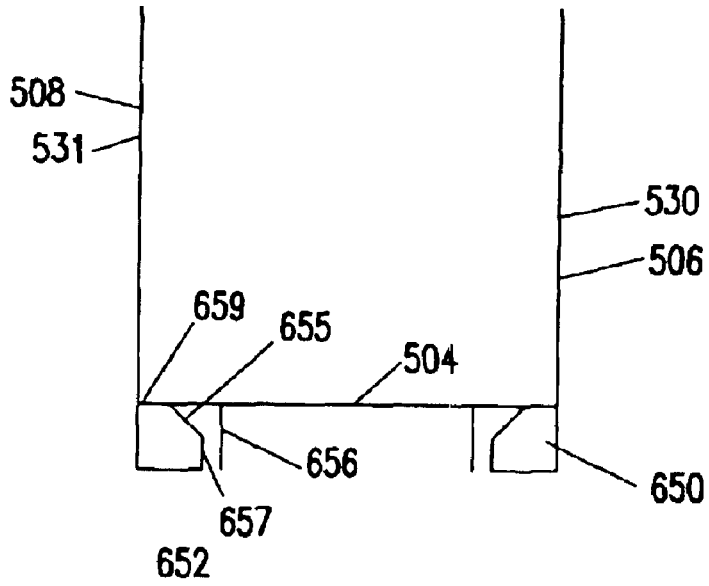
FIG. 42 is a top view of a portion of a block form according to the principles of the invention.

In one embodiment shown in FIG. 42, the pry member includes an angled guide surface. An angled guide surface is any surface that assists in guiding a hinged door into position relative to an adjacent hinged door.

In FIG. 42, the angled guide surface is angled guide surface 655 that is connected to prying surface 657. As the second side hinged door 508 is moved into its molding position (with door 504 already in a position fairly close to the molding position but perhaps not perfectly in its molding position), the angled guide surface 655 may strike the edge 659 of door 504. The engagement between angled guide surface 655 and edge 659 causes the door 504 to be guided more exactly into its molding position. Likewise pry member 650 on door 506 is shown with an angled guide surface 661.

It is desirable that one person be able to move all of the hinged doors from the open position to the molding position without assistance from another person. Such task must also be performed in a safe manner. In order to accomplish this result, a safety latch has been invented for temporarily holding two adjacent doors in substantially the molding position while the other two doors are moved into the molding position.

A safety latch includes two substantially parallel rods or bars that are connected by a connecting member. A connecting member can be a separate member from the two substantially parallel rods or the connecting member and two rods can be one integrally formed member. A safety latch may be U-shaped, or it may have square corners. The exact shape is not important as long as the two substantially parallel rods can each be placed into holes and the connecting member prevents the two rods from separating from each other.

In one embodiment, safety latch is safety latch 660 shown in FIGS. 23, 25, 26 and 27. Safety latch 660 includes first rod 662, second rod 664 substantially parallel to first rod 662, and connecting member 666 that is integrally a part of the first and second rods 662 and 664.

In order to utilize the safety latch in a block form, two adjacent hinged doors must include first and second members respectively wherein said first and second members define holes for receipt to the first and second rods of the safety latch. By positioning the first rod of the safety latch into the first hole of the first member of one hinged door and the second rod of the safety latch into the hole of the second member of the adjacent hinged door, the first and second hinged doors are held in the molding position.

Figure 25:
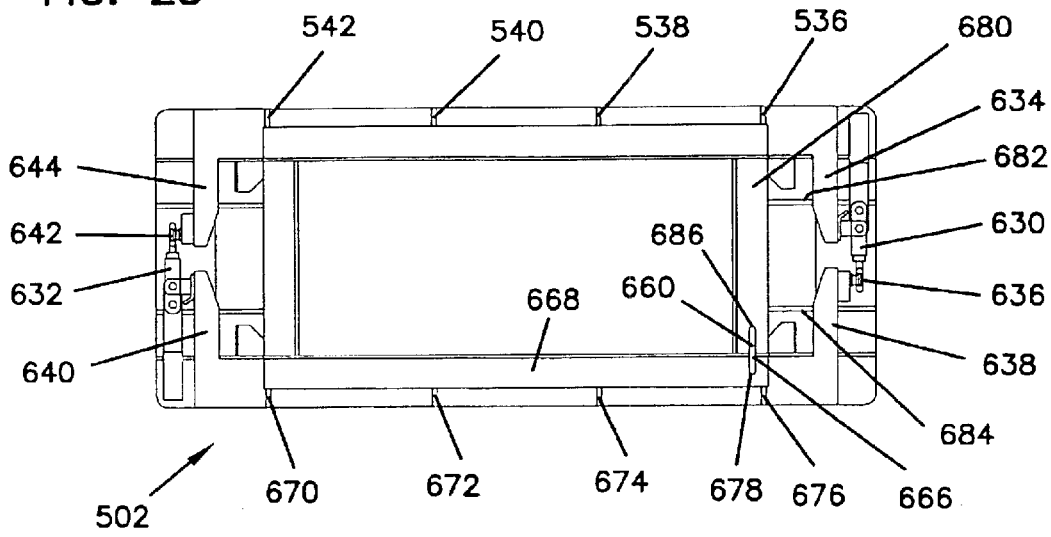
FIG. 25 is a top view of a full block form according to the principles of the invention.

One embodiment of first and second members is shown in the top view of the block form 502 shown in FIG. 25. In this embodiment, first member is a horizontal plate 668 that is welded onto gussets 670, 672, 674, and 676 of second side hinged door 508. Horizontal plate 668 defines a hole 678 for receipt of second rod 664 of safety latch 660. Second member is a horizontal plate 680 that is welded onto gussets 682 and 684 of first end hinged door 504. Horizontal plate 680 defines a hole 686 for receipt of first rod 662 of safety latch 660.

The end of first rod 662 of the safety latch 660 is threaded for receipt of a nut 688. Nut 688 prevents the safety latch from becoming detached from the block form 502. However, nut 688 is located at a position on first rod 662 that allows the second end 664 to be lifted up out of the hole 678 so that the safety latch can be engaged and disengaged by rotating the second rod 664 in and out of the hole 678.

The method for one person moving all four hinged doors of the block form 502 from an open position to the molding position is now described. The second side hinged door 508 and the first end hinged door 504 are moved into their molding positions. The second end 664 of the safety latch 660 is rotated until it is directly over the hole 678. The second end 664 is then placed into the hole 678. At this point the second hinged door 508 and the first end hinged door 504 are held in their molding positions by the safety latch 660. Next, the remaining two hinged doors 506 and 509 are moved into their molding positions. Then the locking mechanisms such as clamps 630 and 632 are activated to lock all four hinged doors in the molding position. At this point, the moldable concrete is poured into the block form and allowed to harden.

One or more vibrators may be coupled to each block form for removing air bubbles from the moldable concrete as it hardens. Alternatively, one vibrator may be placed on a supporting structure for vibrating more than one block forms. Alternatively, a block for with no vibrators may be built and alternative methods of removing air bubbles from the moldable concrete used.

In the embodiment shown in FIGS. 23–27, see specifically FIG. 24, a vibrator 690 is attached to the supporting structure directly under block form 502 and a second identical vibrator (not shown) is attached to the supporting structure directly under block form 502'.

The vibrators 690 and 692 are standard off the shelf compressed air vibrators such as Model #SK51 made by Isko. Other vibrators such as electric driven vibrators can also be used.

In the embodiment shown in FIG. 23, the supporting structure 500 is supported by rubber feet 694 and 696 as well as by identical rubber feet in the other two corners of the supporting structure 500 (not shown). The rubber feet improve the vibrational dynamics of the entire molding machine thus enhancing vibration and therefore minimizing the size and cost of the vibrating device that would otherwise be necessary without the rubber feet.

FIGS. 26 and 27 are both a side view of the block form 502 viewing the second side hinged door 508. FIG. 26 shows the first end hinged door 504 and the second end hinged door 509 in their molding positions. FIG. 27 shows the first end hinged door 504 in its open position prevented from rotating further by the safety stop 697. It is noted that the cross sectional view in FIG. 27 has been extended to include the supporting structure 500. The details of the parts on the side of the block form 502 shown in FIGS. 26 and 27 are not explained in detail as they mirror the first side hinged door side.

The supporting structure 500 includes two parallel hollow beams 698 and 700 supported by the rubber feet. The hollow beams 698 and 700 are secured to each other by plates 512 and 514 and 512' and 514', which are welded in place. The platform 590 is created by placing two more hollow beams 702 and 704 across the beams 698 and 700. A flat panel forming platform 590 is then welded onto the beams 702 and 704. The times on the fork of a forklift can be inserted into the two of the ends of hollow beams 698, 700, 702 and 704 for lifting the supporting structure 500 along with the associated block forms 502 and 502'.

A half block form is a form for forming half blocks. A half block form is similar to a full block form except that the side walls are half the width of a full block form. Additionally, the inserts and cutouts on the molding surfaces of the side walls are shaped differently to form the different tongue sets on the half block.

One embodiment of a half block form is shown in FIGS. 31–34. As most of the details of the half block form are similar to the full block form described earlier, the details will not be described in full here. However, some of the general aspects of the half block form will be discussed.

Figure 31:
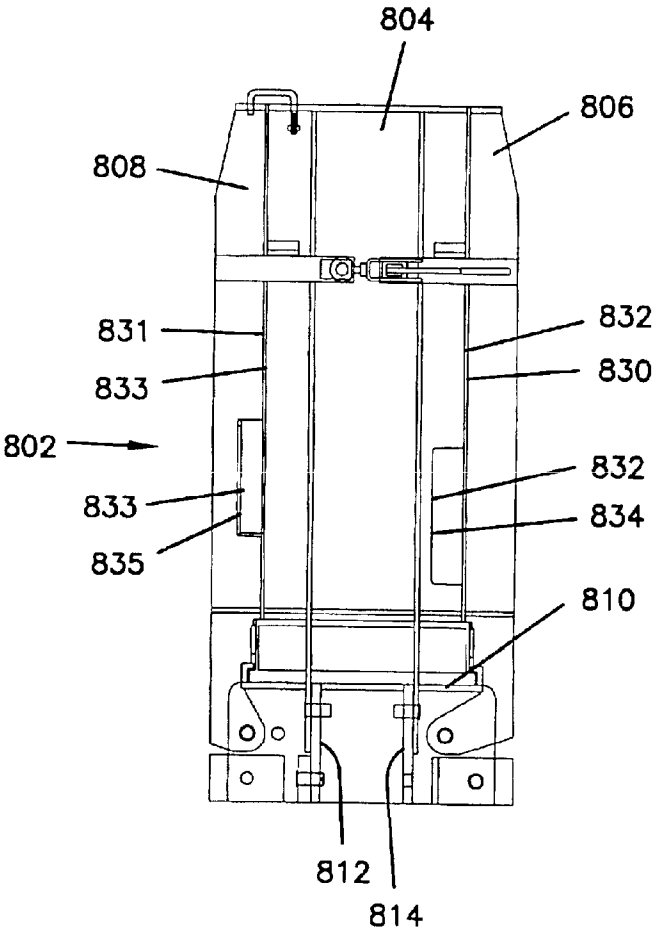
FIG. 31 is a side view of a half block form according to the principles of the invention.
Figure 33:
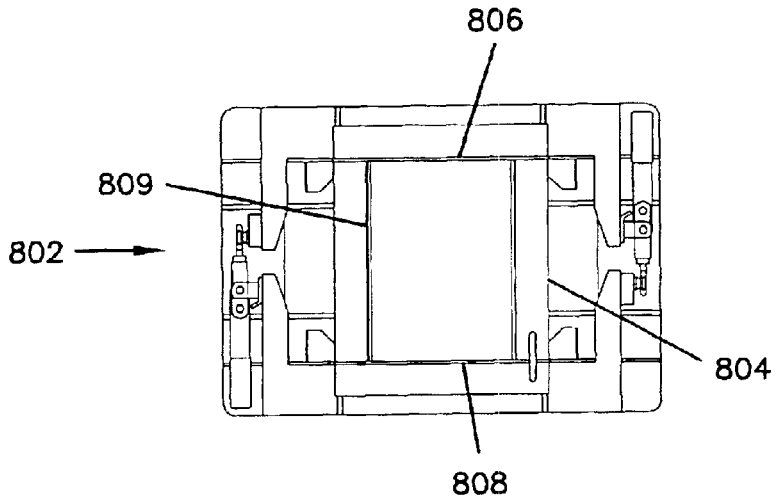
FIG. 33 is a top view of a half block form according to the principles of the invention.
Figure 34:
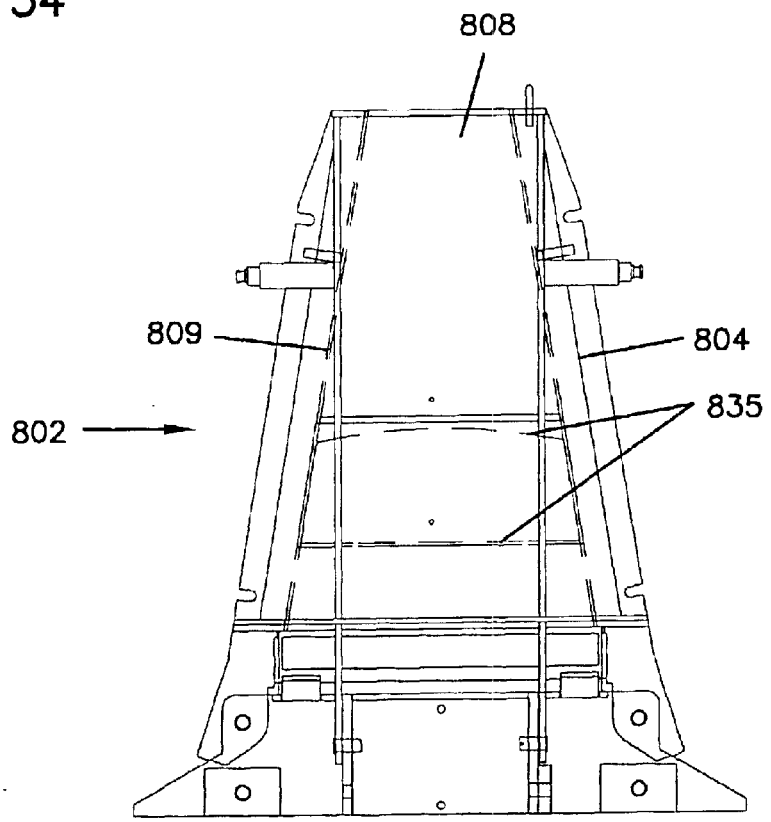
FIG. 34 is an end view of a half block form (opposite the view in FIG. 32) according to the principles of the invention.
Figure 35:
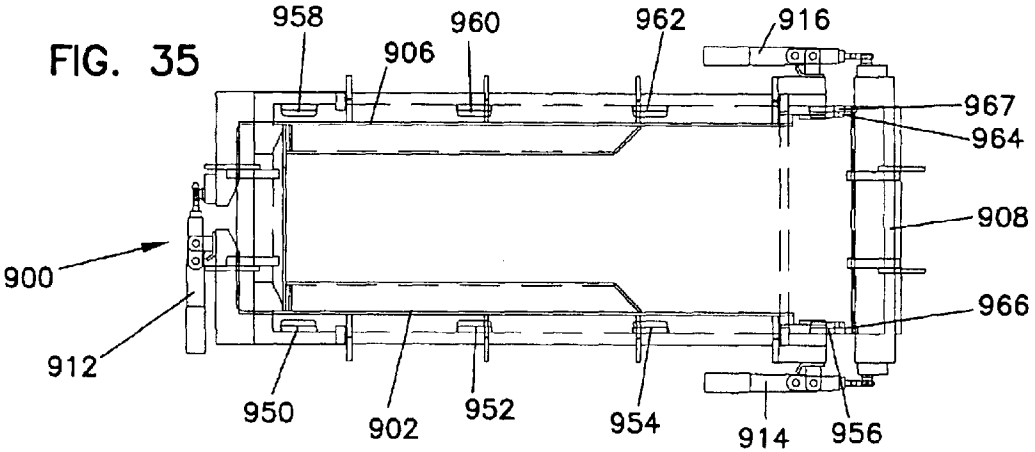
FIG. 35 is a top view of a corner block form according to the principles of the invention.
Figure 37:
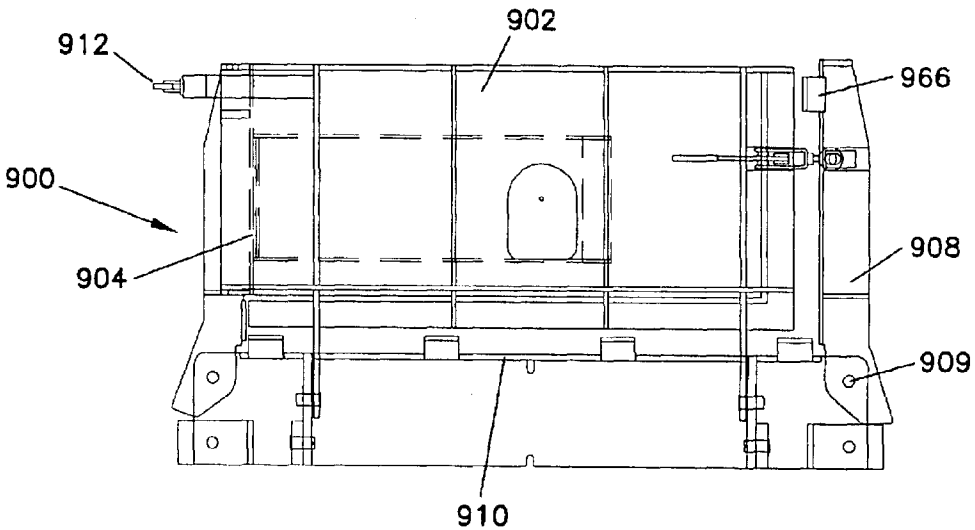
FIG. 37 is a side view of a corner block form according to the principles of the invention.
Figure 36:
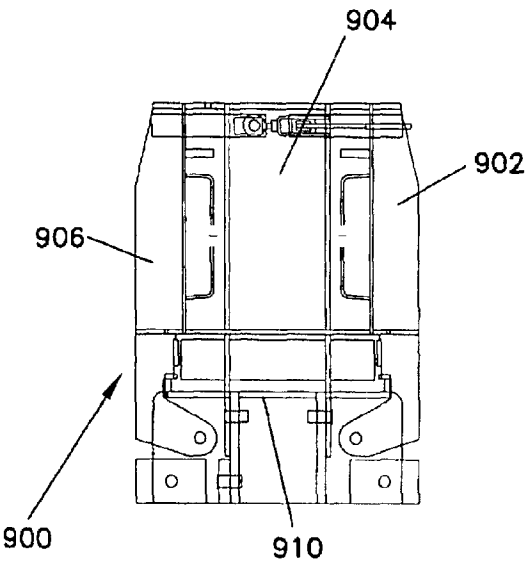
FIG. 36 is an end view of a corner block form according to the principles of the invention.
Figure 38:
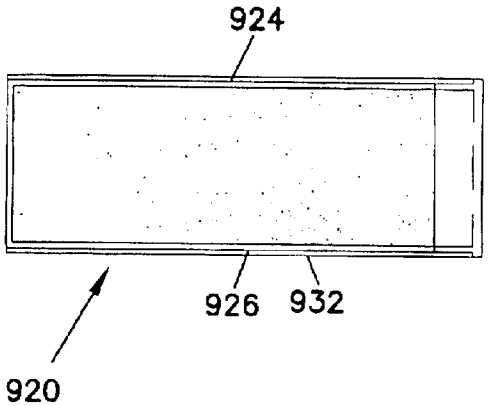
FIG. 38 is a top view of a corner block face form according to the principles of the invention.

Half block form 802 includes four hinged doors, namely end hinged door 804, first side hinged door 806, and second side hinged door 808 can be seen in FIG. 31. A second end hinged door 809 is oppositely disposed from first end hinged door 804 is shown in FIGS. 33–34. Bottom 810 is supported by the supporting structure (not shown) through plates 812 and 814. The supporting structure for the half block form 802 is modified compared to the full block form by moving the hinge points on the supporting structure inward to accommodate smaller side doors and end doors that are moved inward as shown in the Figures.

The first hinged door 806 includes a molding panel 830 having a molding surface 832. Since the half block form 802 is configured for forming half blocks of the configuration disclosed earlier in this application, the molding surface 832 is shaped generally planar with a protrusion 834 for forming a groove in the bottom surface of the block. A protrusion in the molding surface of a molding panel can be any shape or configuration desired for the shape and configuration of the block being formed. The block form of this invention is not limited to the formation of the retaining wall blocks discussed above. Other block shapes including tongue and groove shapes may be manufactured using the block forms of this invention.

Second side hinged door 808 includes a molding panel 831 having a molding surface 833. The molding surface 833 is shaped generally planar but with a recess for forming a tongue set in the top surface of the block. In this embodiment, the recess 835 is in the shape of the tongue set of the embodiment shown above with respect to FIGS. 11–14.

The face form for a half block form is similar to the face form for a full block form with the difference being the exact dimensions. In other words, the half block face form has dimensions corresponding with the dimensions of the front surface of the half block.

We now turn to the corner block form and its face form shown in FIGS. 35–41. Corner block form 900 includes four hinged walls 902, 904, 906 and 908 and bottom 910.

Corner block form 900 includes first, second and third over center clamps 912, 914, and 916. First clamp 912 operates the same as the clamps described above with respect to the full block form. Second and third clamps 914 and 916 operate together to move the door 908 from its molding position to an open position. In one embodiment, movement from molding position to open position is a translation of the door 908 to the right in FIG. 37 by about 1 inch. Of course, the exact distance of movement of the door is not limiting to this invention.

The door 908 is preferably removable from the supporting structure while the other doors may be removable as well.

Figure 40:
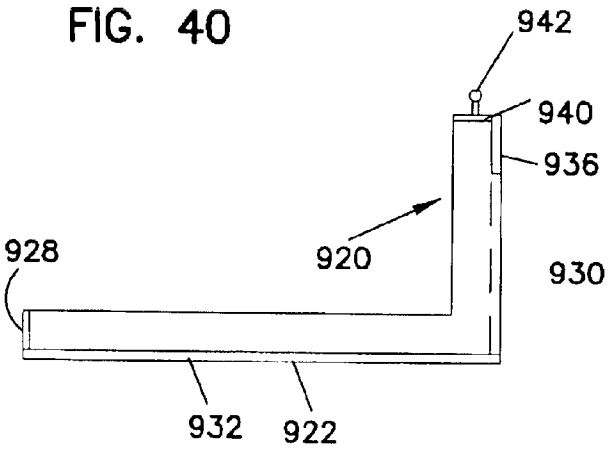
FIG. 40 is a side view of a corner block face form according to the principles of the invention.
Figure 39:
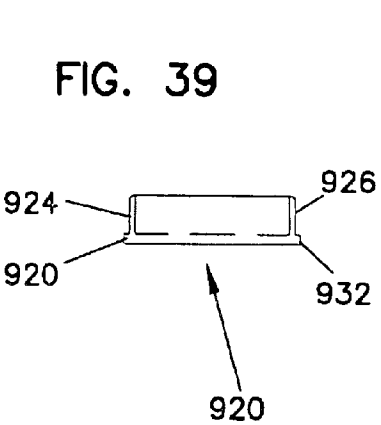
FIG. 39 is an end view of a corner block face form according to the principles of the invention.
Figure 41:
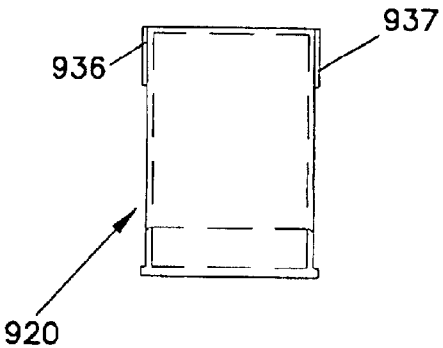
FIG. 41 is an end view of a corner block face form according to the principles of the invention.

FIGS. 39–41 illustrate an embodiment of a corner block face form. Face form 920 includes a bottom surface 922, first and second side walls 924 and 926 and first and second end walls 928 and 930. Second end wall 930 is taller than first end wall 928 to correspond with the second front surface of a corner block. Of course either end wall could be the taller end wall. Second end wall 930 and bottom surface 922 are the surfaces that form the exposed surfaces of the corner block. In other words bottom surface 922 forms the first front surface of the corner block and second end wall 930 forms the second front surface of a corner block.

Anchor rails 932 and 934 extend from side walls 924 and 926 respectively for sliding interaction with anchor rail clamps on the corner block form. Vertical anchor rail 936 is coupled to second end wall 930 for sliding interaction with a vertical anchor rail clamp to be described further below.

In one embodiment, a top 940 is removably attached to the taller end wall 930. This removable top 940 includes a handle 942. The reason for removability of the top 940 will be described below.

Operation of the corner block form and the corner block face form will now be described. The various doors of the form are positioned as follows for insertion of the face form into the form. The end door 908 is removed from the supporting structure. The two side doors 902 and 906 are moved into their open position and the first end door 904 is either removed from the supporting structure or rotated about its hinge down to a substantially horizontal position (by removal of its associated safety stop(s)). Once the doors are in the above positions, the face form 920 is slid into the form 900 through the area where the first end door would normally be positioned when attached to the block form. The second end wall 930 is inserted into the form first so that it is eventually nearest to the door 908. The anchor rail clamps 950, 952, 954 and 956 slidably receive the anchor rail 932. The anchor rail clamps 958, 960, 962 and 964 slidably receive the anchor rail 934. Next, the door 908 is moved downward in a vertical motion so that vertical anchor rail clamp 966 that is coupled to door 908 slidably receives vertical anchor rail 936 and a corresponding anchor rail clamp 967 also coupled to door 908, and opposite anchor rail clamp 966, receives vertical anchor rail 937. Door 908 is then attached to the supporting structure at hinge point 909.

Once the face form is in place, the doors can be moved from their open position to molding position. The clamps 912, and 914 and 916 are then clamped down to secure the doors in the molding position. At this time the removable top 940 is placed on top of the end 930 of the face form 920. The removable top 940 is removed to provide clearance as the door 908 is vertically moved down into position after the face form is in place.

The above specification, examples and data provide a complete description of the manufacture and use device of the invention. Since many embodiments of the invention can be made without departing from the spirit and scope of the invention, the invention resides in the claims hereinafter appended.

We claim:

1. A retaining wall block suitable for forming a retaining wall by stacking multiple blocks into successive overlying courses of blocks, said retaining wall block comprising:

(a) top and bottom surfaces substantially parallel to each other;

(b) a front surface connecting the top and bottom surfaces;

(c) a back surface opposite the front surface;

(d) first and second side surfaces connecting the top and bottom surfaces, wherein the first side surface forms a first angle with the front surface, and the second side surface forms a second angle with the front surface, wherein the first and second angles are less than 90 degrees;

(e) a groove in the bottom surface, the groove extending from the first side surface to the second side surface, the groove having a depth and a width;

(f) a tongue set comprising one or more tongues projecting from the top surface, the tongue set comprising a front-facing surface set comprising one or more front-facing surfaces, and the tongue set comprising a rear-facing surface set comprising one or more rear-facing surfaces, the rear-facing surface set comprising a first curved section having a first radius and a second curved section having a second radius, wherein the first and second curved sections are convex as viewed from the back surface and wherein the first and second curved sections have a first and a second apex respectively, wherein a first midpoint is defined halfway between the first apex and the front-facing surface set of the tongue set along a line normal to the front face of the block, and a second midpoint is defined halfway between the second apex and the front-facing surface set of the tongue set along a line normal to the front face of the block; and (g) the first radius is greater than one fourth the distance between the first and second side surfaces measured along a line including the first and second midpoints and the first radius is less than 1000 inches, and the second radius is greater than one fourth the distance between the first and second side surfaces measured along the line including the first and second midpoints and the second radius is less than 1000 inches.

2. The retaining wall block according to claim 1 wherein the front surface is a substantially planar surface.

3. The retaining wall block according to claim 1 wherein the first and second angles are between 70 degrees and 90 degrees.

4. The retaining wall block according to claim 1 wherein the first and second angles are between 80 degrees and 82 degrees.

5. The retaining wall block according to claim 1 wherein the tongue set comprises a single tongue.

6. The retaining wall block according to claim 1 wherein the retaining wall block is made from wet cast concrete.

* * * * *